US010766641B2

(12) United States Patent
Edwards et al.

(10) Patent No.: US 10,766,641 B2
(45) Date of Patent: Sep. 8, 2020

(54) METHOD AND APPARATUS FOR A PRODUCT SETTLER

(71) Applicant: Frito-Lay North America, Inc., Plano, TX (US)

(72) Inventors: Eduard Edwards, Arlington, TX (US); Chad Arthur Huebner, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 871 days.

(21) Appl. No.: 14/581,110

(22) Filed: Dec. 23, 2014

(65) Prior Publication Data

US 2016/0176549 A1 Jun. 23, 2016

(51) Int. Cl.

| | |
|---|---|
| ***B65B 1/22*** | (2006.01) |
| ***B65B 9/10*** | (2006.01) |
| ***B65B 1/04*** | (2006.01) |
| ***B65B 9/20*** | (2012.01) |
| ***B65B 31/04*** | (2006.01) |
| ***B65B 1/24*** | (2006.01) |
| ***B65B 51/30*** | (2006.01) |
| ***B65B 59/04*** | (2006.01) |

(52) U.S. Cl.

CPC ..... *B65B 1/22* (2013.01); *B65B 1/04* (2013.01); *B65B 1/24* (2013.01); *B65B 9/10* (2013.01); *B65B 9/20* (2013.01); *B65B 31/045* (2013.01); *B65B 51/306* (2013.01); *B65B 59/04* (2013.01)

(58) Field of Classification Search

CPC .... B65B 1/22; B65B 1/04; B65B 1/24; B65B 9/10; B65B 9/20; B65B 31/045; B65B 51/306; B65B 59/04

USPC ..... 53/437

See application file for complete search history.

(56) References Cited

U.S. PATENT DOCUMENTS

| | | | | |
|---|---|---|---|---|
| 2,863,475 | A | 12/1958 | Lau | |
| 2,915,866 | A * | 12/1959 | Bartlo | B29C 66/1122 53/526 |
| 2,960,808 | A * | 11/1960 | Pike | B65B 9/213 53/428 |
| 3,070,931 | A * | 1/1963 | Zwight | B65B 9/213 177/185 |

(Continued)

FOREIGN PATENT DOCUMENTS

| | | |
|---|---|---|
| EP | 2489594 A2 | 2/2012 |
| GB | 1037445 | 7/1966 |

*Primary Examiner* — Sameh Tawfik

(74) *Attorney, Agent, or Firm* — Barnes & Thornburg LLP; G. Peter Nichols

(57) ABSTRACT

A method and apparatus for settling a product in a partially formed package. In one aspect, the invention comprises the steps: providing a partially formed package; filling the partially formed package with a product; and settling the product in the partially formed package. The settling step comprises rotating a paddle wheel comprising at least one paddle against the partially formed package. In a second aspect, the invention comprises an improved product settler for settling product in a partially formed package. The improved product settler comprises a paddle wheel. The paddle wheel comprises at least one paddle that is positioned to cause an impact against the partially formed package. The impact agitates the partially formed package and thereby settles the product.

30 Claims, 10 Drawing Sheets

(56) References Cited

U.S. PATENT DOCUMENTS 3,525,193 A * 8/1970 Cutler ..... B65B 9/213 53/437
3,614,850 A * 10/1971 Brochot ..... B65B 1/24 493/379
3,668,815 A * 6/1972 Henry ..... B65B 1/22 53/437
3,789,888 A 2/1974 James
4,253,292 A 3/1981 Lipes
4,262,473 A 4/1981 Brooke
4,274,244 A * 6/1981 Gilbert ..... B29C 53/50 53/451
4,363,341 A * 12/1982 Powell ..... A01G 9/081 141/183
4,483,126 A * 11/1984 Henry ..... B65B 51/30 53/551
4,606,174 A * 8/1986 Berg ..... B65B 3/04 426/410
4,663,917 A * 5/1987 Taylor ..... B29C 65/18 53/374.3
5,125,213 A * 6/1992 Focke ..... B65B 1/22 53/437
5,442,898 A 8/1995 Gabree
5,473,866 A * 12/1995 Maglecic ..... B65B 1/22 53/151
5,505,037 A 4/1996 Terminella
5,548,947 A 8/1996 Fincham
5,575,137 A * 11/1996 Metz ..... B65B 51/30 53/551
5,768,852 A 6/1998 Terminella
5,881,539 A * 3/1999 Fukuda ..... B65B 9/213 53/374.5
6,047,521 A 4/2000 Terminella
6,079,929 A 6/2000 Muma
6,119,438 A * 9/2000 Bacon ..... B65B 9/20 53/451
6,463,720 B1 10/2002 Cherney
6,488,100 B2 12/2002 Underhill
6,581,360 B1 * 6/2003 Hirsh ..... B65B 51/306 53/551
7,178,313 B2 * 2/2007 Bezek ..... B65B 9/2042 53/155
7,654,064 B2 2/2010 Riccardi
8,028,503 B2 10/2011 Capodieci
8,225,585 B2 * 7/2012 Bohler ..... B65B 9/20 53/436
8,424,671 B2 * 4/2013 Tokuda ..... B65B 9/20 193/2 R
8,640,847 B2 * 2/2014 Nishitsuji ..... B65G 11/20 193/2 B
9,227,745 B2 * 1/2016 Miyamoto ..... B65B 1/22
2002/0002810 A1 1/2002 Nakagawa
2010/0215813 A1 * 8/2010 Peterson ..... B65B 9/2007 426/106
2010/0330237 A1 12/2010 Deering
2012/0145516 A1 6/2012 Tokuda
2013/0059709 A1 3/2013 Miyamoto
2013/0062601 A1 3/2013 Yamazaki
2016/0176548 A1 6/2016 Edwards
2016/0176549 A1 6/2016 Edwards
2016/0368644 A1 12/2016 Uraoka
2017/0029141 A1 2/2017 Cherney

* cited by examiner

METHOD AND APPARATUS FOR A PRODUCT SETTLER

BACKGROUND OF THE INVENTION

Technical Field

The present invention relates to an apparatus and method for settling products in a package.

Background

Many foodstuffs, such as potato chips, are packaged in pillow pouch packages that are made using a form, fill and seal ("FFS") machine. Typically, a form, fill and seal machine forms the film into a tube, seals the bottom of the tube, fills the partially sealed tube with product, and then seals the top of the tube to form a packaged product. Often, a form, fill and seal machine is oriented so that film travels in a direction that is generally vertical as the film is formed into a tube, filled with product and sealed. Such a machine is an example of a vertical form, fill and seal ("VFFS") machine.

When the product being packaged is an irregularly shaped product such as potato chips, there can be large void spaces between each piece. The void space takes up volume in the package and requires the package to be larger than required for the product alone. This requires more resources, which is less environmentally friendly. It is also more expensive for producers and ultimately consumers.

To avoid these and other problems posed by void space, some form, fill and seal machines are fitted with product settlers. These settlers typically shake the product to make it settle into a more compact configuration and thereby reduce void space.

In addition to reducing void space in a product, it is desirable to package product more quickly. One way to increase the speed with which product is packaged is to increase the speed with which film is fed to the form, fill and seal machines. Other things being equal, continuously feeding film to a machine is faster than intermittently feeding film.

To take advantage of this principle, some machines, called continuous motion machines, are capable of running in a continuous mode in which film is continuously being advanced, as opposed to being paused intermittently. However, running a machine in continuous mode is incompatible with conventional settlers that grab or pinch the film. This is because grabbing or pinching will damage the film unless the film is paused.

Examples of conventional settlers that require a film to be paused include settlers with beater bars that grab and shake the film. Another conventional settler that requires film to be paused uses two swinging panels. The two panels are positioned below the product conduit and can rotate together like doors. When the panels come together, they pinch and seal off the film below the product conduit. After product falls on the closed panels, seal jaws come together to form an end seal on the film. This forms the bottom of a partially formed package. Then, the panels rotate open, which releases the film and allows the product to fall to the bottom of the partially formed package. This process of repeatedly dropping and catching the product causes the product to be settled. However, it can also damage the product by causing breakage, for example, of chips.

As these examples illustrate, when using conventional settlers, form, fill and seal machines must run in an intermittent mode in which the film is stopped when the settlers grab the film, and the film advances when the settlers release the film. As a result, many continuous motion machines do not even come with a settler. Other machines come with a settler that can be installed by a user, but the machine must then be run in an intermittent mode. Running machines in intermittent mode is inefficient and results in additional wear and tear on the machines and film. Thus, using a conventional settler with a continuous motion form, fill and seal machine can be undesirable.

Accordingly, it would be advantageous to have a settler that is compatible with a form, fill and seal machine running in continuous mode. For example, it is desirable to have a settler that does not grab film and can be used with a machine that continuously conveys the film. Such a settler would not require the film to be paused during production of packages. This could, in turn, avoid wear and tear on the machine and film caused by large transient forces that occur when starting and stopping the machine.

It would also be advantageous if an inventive settler could be used to produce product-filled packages more quickly than conventional settlers that require packaging film to be paused intermittently.

In addition, it would be desirable if the inventive settler reduced the volume that product occupies in a package. For example, it would be desirable if the settler reduced the volume occupied by a product at least as much as a conventional settler.

Furthermore, it would be desirable if an inventive settler could increase the head space in a package of a given size. For example, increased head space can help prevent product inside the package from being too close to, or caught in, the end seal of the package. This helps to ensure that the package is properly sealed. Increased head space can also help prevent other manufacturing defects, for example, unintended pleats and unintended tucks. It would be even more desirable if the inventive settler could increase head space and/or reduce manufacturing defects when compared to conventional settlers.

Likewise, it would be beneficial if the inventive settler did not break a substantial amount of product by impacting the product. For example, it would be beneficial if the settler were positioned so that it did not impact a substantial amount of the product through the packaging film. It would also be advantageous if the inventive settler could optionally be mounted somewhere besides the seal jaw carriage of a form, fill and seal machine. As another example, it would be beneficial if the inventive settler could operate intermittently or continuously. For example, it would be beneficial if the inventive settler could stop settling while the product is in a position to be damaged by the settler. However, after the product is no longer in such a position, the inventive settler would begin settling again.

Similarly, it would be desirable if the inventive settler decreased the amount of film required to package a given amount of product. This could help reduce waste, increase the environmental friendliness of a process, reduce manufacturing costs, and further increase the speed of a manufacturing process. For example, using a settler that can be used with a continuous motion form, fill and seal machine can increase the speed of a manufacturing process. Also, if the inventive settler could decrease the amount of film necessary to package a product, less film would need to be conveyed for a unit of product. This could further reduce the amount of time required to produce each unit.

In addition, it would be advantageous if the inventive settler did not interfere with the continuous motion of a package film when the inventive settler stopped. For example, it would be advantageous if the inventive settler had a low torque motor so that if the settler stopped running or even failed while the settler was in contact with a package film, the film could push the settler out of the path of the film, and the film could continue to be advanced. It would also be advantageous if the inventive settler could be stopped in a position where it does not impede the continuous conveyance of packaging film.

It would be another benefit if the inventive settler were simple compared to conventional settlers. For example, it would be beneficial if the inventive settler had fewer moving parts than conventional settlers, had a less complicated operating mechanism, and were easier to maintain, repair and/or replace. It would also be beneficial if the inventive settler required minimal training of or input from maintenance personnel.

Furthermore, it would be useful if the inventive settler were small compared to conventional settlers. For example, conventional settlers can have components that take up a large amount of space and it would be advantageous to avoid these components.

Additionally, it would be desirable if the inventive settler could be easily installed on existing form, fill and seal machines. For example, it would be desirable if the inventive settler were modular and could be easily added to existing continuous motion vertical form, fill and seal machines. It would also be useful if a modular form of the inventive settler were easier to maintain, repair, and/or replace than conventional settlers. For example, it would be desirable if an inventive settler needing maintenance could be easily removed from a continuous motion form, fill and seal machine and replaced with a recently serviced settler. It would also be desirable if the inventive settler were designed so that the form, fill and seal machine could run without needing to be substantially reconfigured if the inventive settler were removed and were not replaced. For example, the machine could be instructed to create bigger packages due to a lack of settling, but the machine would not require other reconfiguration. This could increase the versatility of a product manufacturing line and increase its resilience in the face of maintenance issues.

Similarly, it would be advantageous if a form, fill and seal machine were easier to maintain and repair when the inventive settler is used with the machine instead of a conventional settler. It would also be advantageous if the small size and location of the inventive settler made it easier to access and service the machine compared to conventional settlers. For example, the size and location of conventional settlers can block or substantially impede access to the seal jaw carriage of a form, fill and seal machine. In contrast, it would be advantageous if the inventive settler could be installed on one side of a machine making it easy to access the seal jaw carriage even when the inventive settler is installed. It would also be advantageous if the inventive settler could easily be removed in comparison to a conventional settler, for example, if the inventive settler were modular, as this would also increase the ease of servicing of form, fill and seal machine.

SUMMARY OF THE INVENTION

The present invention is a method and apparatus for settling products. For example, the inventors have developed a new type of settler that can be used in conjunction with a form, fill and seal machine even when the machine is running in continuous mode.

In a first aspect, the invention provides a method for settling a product in a package made on a form, fill and seal machine. The method comprises the steps: providing a package material on a product conduit of a form, fill and seal machine; forming a first end seal on the package material to form a partially formed package; filling the partially formed package with product; and settling the product in the partially formed package while continuously conveying the package material along the product conduit.

In a second aspect, the invention provides an apparatus comprising an improved continuous motion form, fill and seal machine. The machine comprises a product conduit, a conveyor, and seal jaws. The conveyor is positioned to convey a package material that is wrapped around the product conduit, and the conveyor moves the package material along the product conduit. The seal jaws are positioned adjacent to opposite portions of the package material to form a first end seal on the package material, thereby forming a partially formed package. The product conduit is positioned so that a product passing through the product conduit will enter the partially formed package after exiting the product conduit, and the product conduit is positioned above the seal jaws. The improvement comprises a product settler comprising a first object positioned to cause an impact against the package material. The impact agitates the package material and settles the product from an unsettled height to a settled height while the machine continuously conveys the package material along the product conduit.

In a third aspect, the invention provides a method for settling a product in a partially formed package. The method comprises the steps: providing a partially formed package; filling the partially formed package with a product; and settling the product in the partially formed package. The settling step comprises rotating a paddle wheel comprising at least one paddle against the partially formed package.

In a fourth aspect, the invention provides an apparatus comprising an improved product settler for settling product in a partially formed package. The improved product settler comprises a paddle wheel. The paddle wheel comprises at least one paddle that is positioned to cause an impact against the partially formed package. The impact agitates the partially formed package and thereby settles the product.

The invention described herein provides many advantages in its various embodiments. In one aspect, the invention provides a settler that is compatible with a form, fill and seal machine running in continuous mode. For example, it provides a settler that does not grab film and can be used with a machine that continuously conveys the film. Such a settler does not require the film to be paused during the production of packages. This, in turn, avoids large transient forces that occur when starting and stopping the machine and avoids associated wear and tear on the machine. In one embodiment, the inventive settler comprises a rotating paddle wheel with a paddle that impacts the film in substantially the same direction that the film is conveyed. Accordingly, in one embodiment, the inventive settler comprises paddles that intermittently contact the film and scrub the film in the film's direction of conveyance.

The inventive settler also can be used to produce product-filled packages more quickly than conventional settlers, which require packaging film to be paused intermittently.

In addition, the inventive settler can reduce the volume that product occupies in a package. For example, the settler reduces the volume occupied by a product at least as much as a conventional settler.

Furthermore, the inventive settler increases the head space in a package of a given size. For example, increased head space can help prevent product inside the package from being too close to, or caught in, the end seal of the package. This helps to ensure that the package is properly sealed.

Increased head space can also help prevent other manufacturing defects, for example, unintended pleats and unintended tucks. Additionally, the inventive settler can increase head space and/or reduce manufacturing defects when compared to conventional settlers.

As another advantage, the inventive settler does not break a substantial amount of product by impacting the product. In one embodiment, the inventive settler causes little or no breakage of product. For example, the settler can be positioned so that the settler does not impact a substantial amount of the product through the packaging film when the settler is in operation. In one embodiment, the inventive settler can be mounted somewhere besides the seal jaw carriage of a form, fill and seal machine. For example, the settler can be positioned just below the product conduit of a form, fill and seal machine so that the settler does not impact a substantial amount of product as the product falls from the product conduit and into the packaging film. The inventive settler can also operate intermittently or continuously. For example, the inventive settler can stop settling while the product is in a position to be damaged by the settler. However, after the product is no longer in such a position, the inventive settler can begin settling again.

The inventive settler can also decrease the amount of film required to package a given amount of product. This helps reduce waste, increase the environmental friendliness of the process, reduce manufacturing costs, and further increase the speed of a manufacturing process. For example, the inventive settler can be used with a continuous motion form, fill and seal machine which increases the speed of a manufacturing process relative to using an intermittent machine. Also, although conventional settlers cannot be used with continuous motion machines, the inventive settler can. Accordingly, the inventive settler can decrease the amount of film necessary to package a product on a continuous motion machine. Since less film needs to be conveyed for a unit of product, this further reduces the amount of time required to produce each unit.

In addition, the inventive settler does not interfere with the continuous motion of a package film when the inventive settler stops. For example, the inventive settler has a low torque motor so that if the settler stops running or even fails while the settler is in contact with a package film, the film can push the settler out of the path of the film, and the film can continue to be advanced. As another example, the inventive settler can be stopped in a position where it does not impede the continuous conveyance of packaging film.

The inventive settler is also simple compared to conventional settlers. For example, compared to conventional settlers, the inventive settler has fewer moving parts, has a less complicated operating mechanism, is easier to maintain, is easier to repair and/or is easier to replace. The inventive settler also requires minimal training of and input from maintenance personnel.

Furthermore, the inventive settler is small compared to conventional settlers. For example, conventional settlers can have components that take up a large amount of space and the inventive settler advantageously avoids this.

Additionally, the inventive settler can be easily installed on existing form, fill and seal machines. For example, in one embodiment, the inventive settler is modular and can be easily added to existing continuous motion vertical form, fill and seal machines. Also, the inventive settler is easier to maintain, repair, and/or replace than conventional settlers. For example, a modular form of the inventive settler can be installed, uninstalled, and serviced with ease. As another example, the inventive settler can be easily removed from a continuous motion form, fill and seal machine and replaced with another inventive settler. Also, the inventive settler is designed so that the form, fill and seal machine can run without needing to be substantially reconfigured if the inventive settler is removed and is not replaced. For example, the machine can be instructed to create bigger packages due to a lack of settling, but the machine does not require other reconfiguration to continue producing product. Accordingly, the inventive settler increases the versatility of a product manufacturing line and increases its resilience in the face of maintenance issues.

Similarly, a form, fill and seal machine is easier to maintain and repair when the inventive settler is used with the machine instead of a conventional settler. In one embodiment, the small size and location of the inventive settler during operation make the machine easier to access and service when compared to machines using conventional settlers. For example, the size and location of conventional settlers can block or substantially impede access to the seal jaw carriage of a form, fill and seal machine. In contrast, the inventive settler can be installed on one side of a machine, rather than, for example, having components that are adjacent to opposite sides of the machine. For example, the inventive settler can comprise a paddle wheel that is positioned adjacent to one side of a product conduit of a form, fill and seal machine. Accordingly, when the inventive settler, as opposed to a conventional settler, is installed on a machine, it is easier to access the components (e.g., seal jaw carriage) of the machine. Furthermore, the inventive settler can easily be removed in comparison to a conventional settler. When the inventive settler is modular, this further increases the ease of servicing a form, fill and seal machine when compared to servicing a machine using a conventional settler.

Another benefit of the inventive settler is that it can be used to settle many different kinds of products. For example, the inventive settler is especially useful for settling larger or irregularly shaped products such as tortilla chips or potato chips. The settler is also useful for settling smaller or regularly shaped products such as Cheetos® cheese puffs. Although, when compared to larger or irregularly shaped products, smaller or regularly shaped products may experience less settling.

Other aspects, embodiments and features of the invention will become apparent from the following detailed description of the invention when considered in conjunction with the accompanying drawings. The accompanying figures are schematic and are not intended to be drawn to scale. In the figures, each identical or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures.

One embodiment of the invention will now be described with respect to FIGS. 1, 2, 3A-3C, and 4A-4B. The embodiment is a method for settling a product in a package 404 made on a form, fill and seal machine. The method comprises the following steps. First, in a providing step 102, a film 202 is provided on a product conduit 204 of a form, fill and seal machine 206 (e.g. a vertical form, fill and seal machine).

Figure 4A:
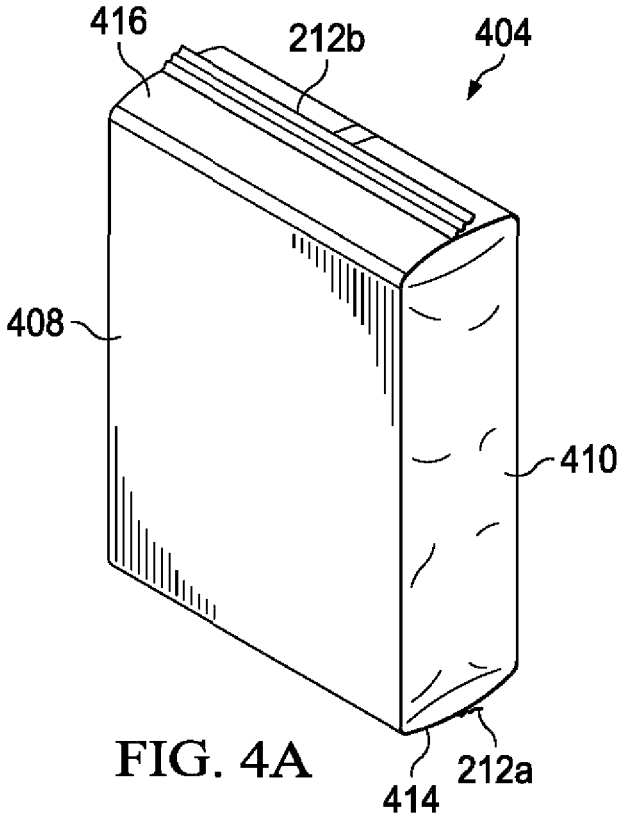
FIGS. 4A-4B are schematic depictions of a package for product that can be settled by one embodiment of the invention.
Figure 4B:
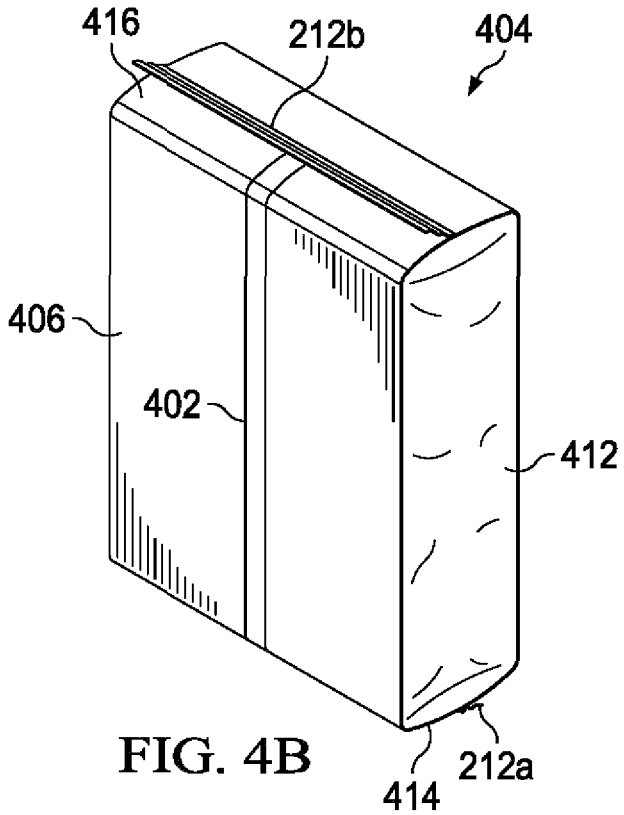

Second, in a longitudinal sealing step 104, the film 202 is sealed to form a longitudinal seal 402 (e.g. back seal) on a package 404. FIGS. 4A-4B depict a package 404 with a first face (e.g., first end 414 or a bottom 414), a second face (e.g., a second end 416 or a top 416), a third face 408 (e.g., a front face), a fourth face 406 (e.g., a back face), a fifth face 410 (e.g., a right face), and a sixth face 412 (e.g., a left face). An example of a longitudinal seal 402 (e.g., a back seal) can be seen on the fourth face 406 (e.g., back side) of the package 404. The longitudinal seal 402 can be useful to form a tube 210 from a film 202 that has been wrapped around a product conduit 204 (e.g., a hollow former). As shown, the tube 210 has a continuous circumference 218. Although a longitudinal seal 402 is provided in some embodiments, in other embodiments, a longitudinal seal is not provided. Accordingly, the longitudinal sealing step 104 is optional. When a longitudinal sealing step 104 is not used to provide a tube-shaped film 210, the tube-shaped film can be provided in other ways, for example, by using a process to produce a blown film, which can have a continuous circumference 218 without using a longitudinal sealing step 104.

Figure 1:
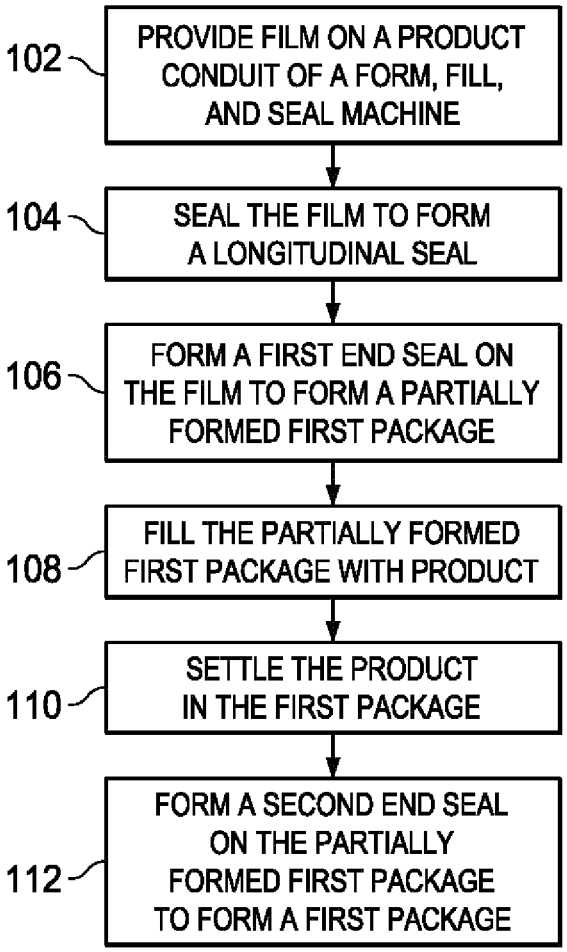
FIG. 1 is a flow chart depicting one embodiment of a process according to the invention.
Figure 2:
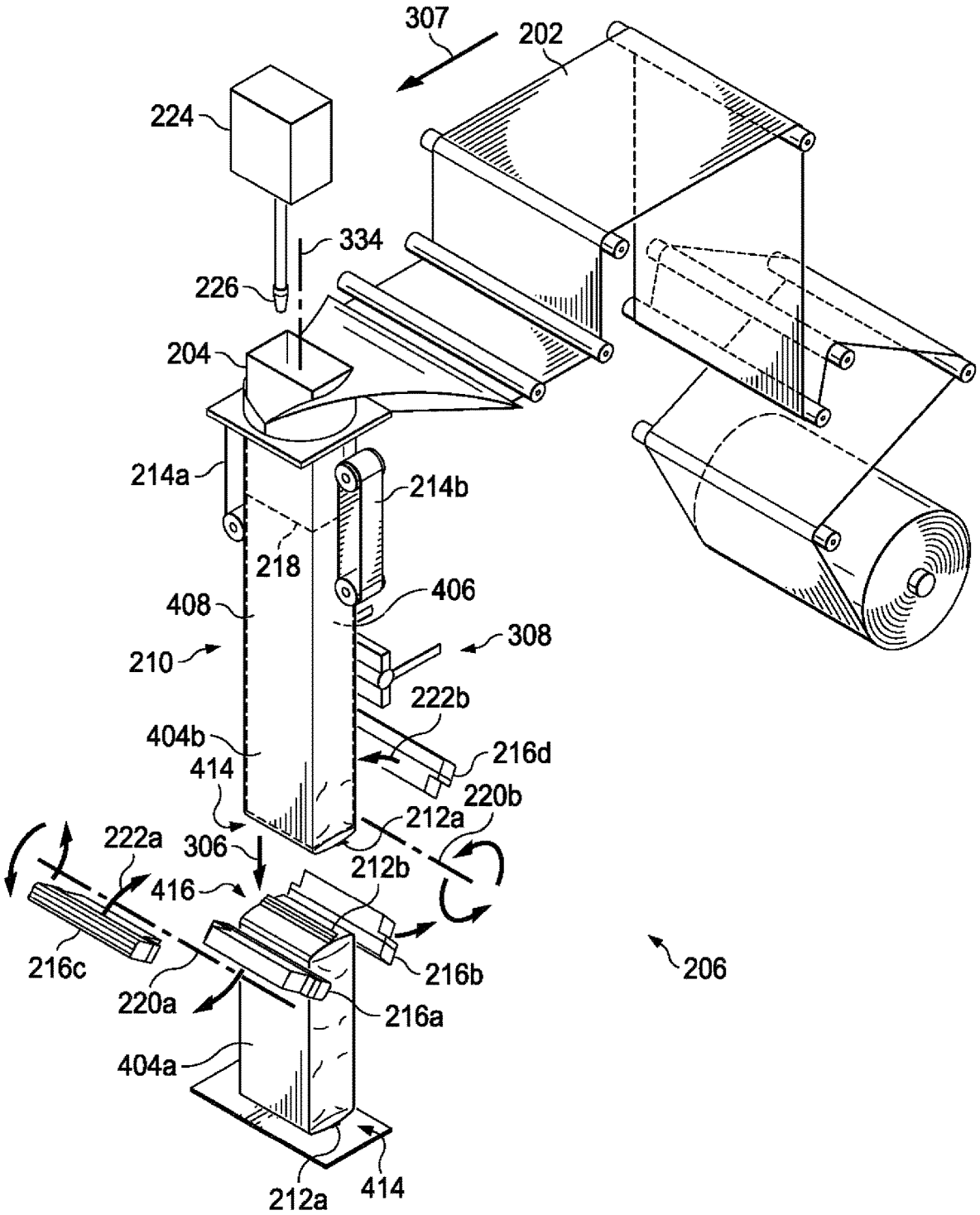
FIG. 2 is a schematic view of one embodiment of the invention for use with a vertical, form, fill, and seal machine.

Third, in a first end-sealing step 106, a first end seal 212*a* is formed on the film 202 to form a partially formed package (e.g., partially formed second package 404*b* in FIG. 2). The first end seal 212*a* is located on a first face (e.g., first end 414) of the partially formed package. As can be seen in FIG. 2, a first package 404*a* has already been formed and a second package 404*b* is a partially formed package. However, before the first package 404*a* was formed, it was also a partially formed package (e.g., partially formed second package 404*b*).

Figure 3A:
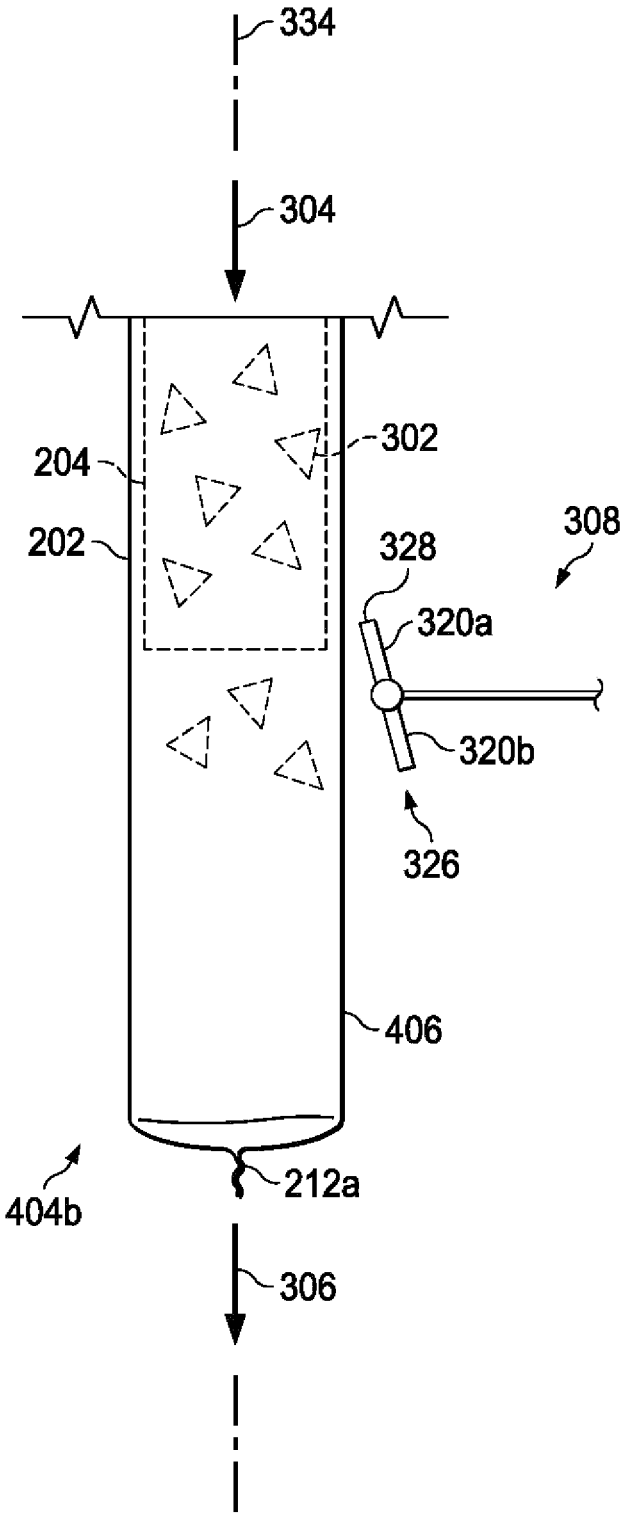
FIGS. 3A-3C are a progression of schematic views of one embodiment of the invention depicting a product settler being used to settle product.
Figure 3B:
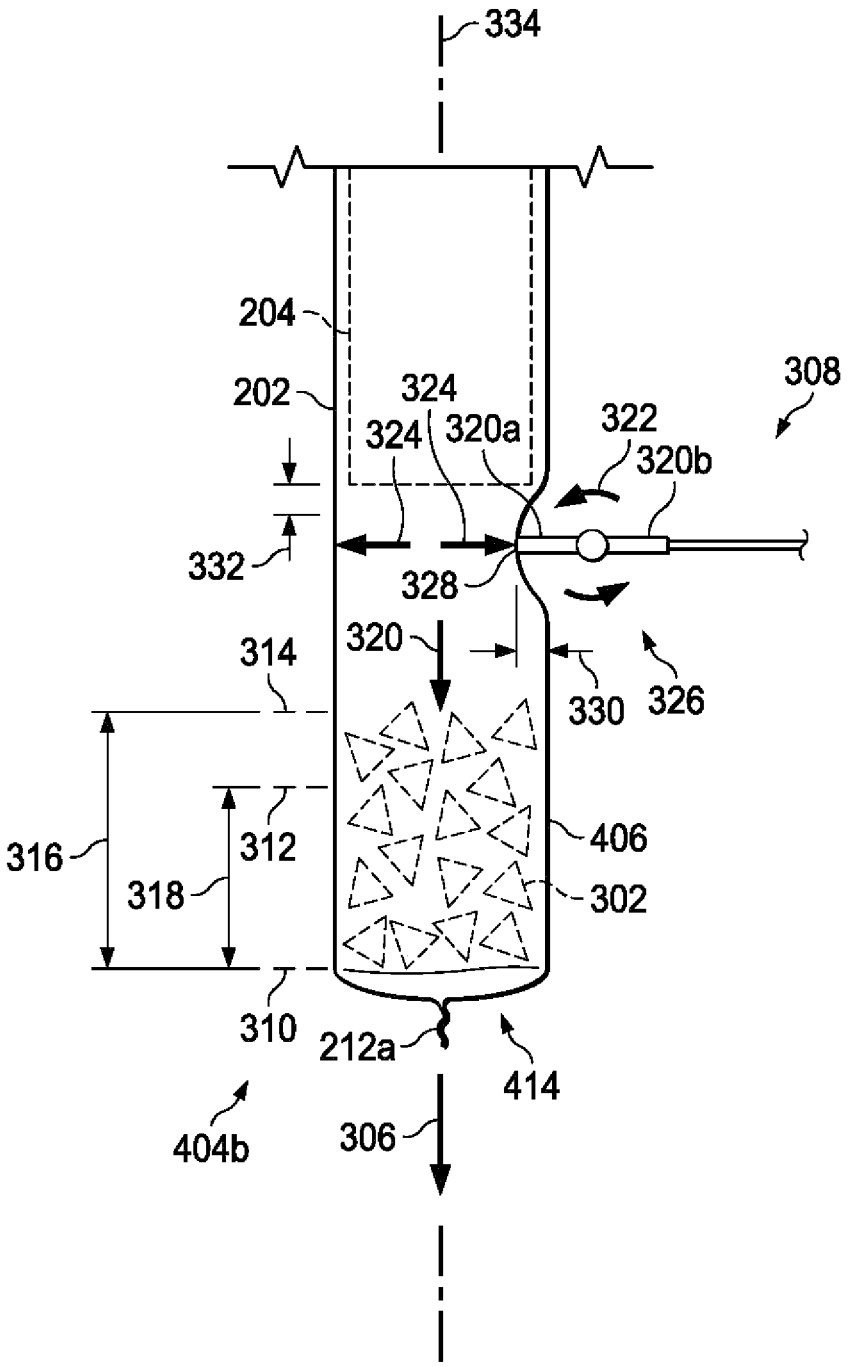

Fourth, in a filling step 108, the partially formed package (e.g., partially formed package 404*b*) is filled with a product 302. An example of how a package 404*b* can be filled with product is illustrated in FIGS. 3A-3B. The product 302 enters the package 404*b* through the product conduit 204. As the product enters the package, it moves in a fill direction 304, and the product 302 falls under the force of gravity. Accordingly, as shown, the fill direction 304 is downward, although other fill directions are also possible.

Fifth, in a settling step 110, the product 302 in the package (see, e.g., partially formed second package 404*b* in FIGS. 3A-3B) is settled while the film 202 is continuously conveyed along the product conduit 204 in a direction of conveyance 306. In one embodiment, the package material is continuously conveyed at a location where the package material is formed into a package (or partially formed package). Additionally, as shown in FIG. 2, the film is continuously conveyed in a direction of conveyance 306 at the product conduit 204, but the film can also be conveyed in a different direction of conveyance 307 at another location.

Figure 3C:
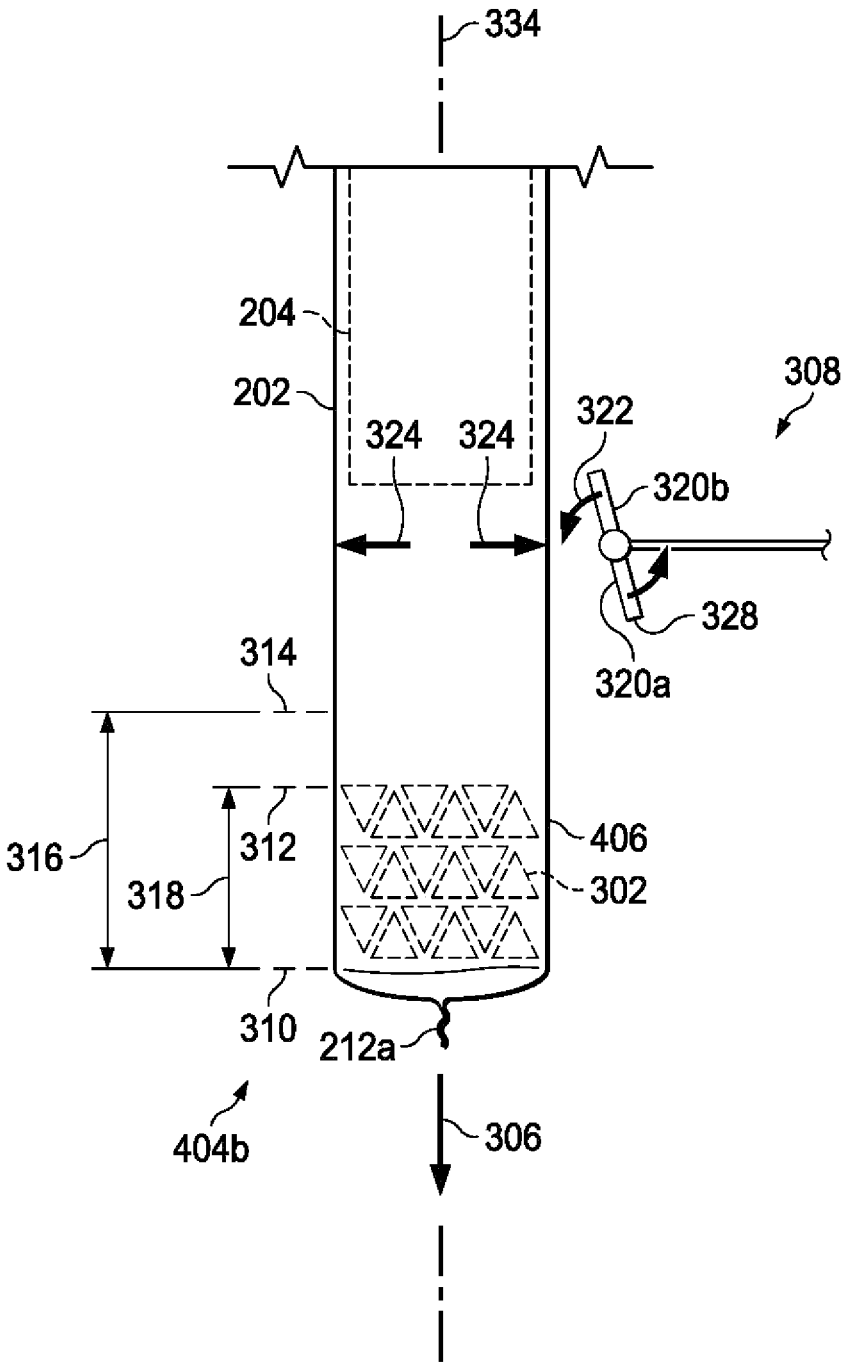

FIGS. 3A-3C illustrate how product 302 is settled in a partially formed package 404*b*. In one embodiment, the inventive settler includes a paddle wheel that rotates and contacts (e.g., scrubs) a package film in the direction of the film's conveyance. The contact between the paddle wheel and the film causes the film to shake and thereby settles product inside the film.

FIG. 3A shows a package 404*b* being filled with the product 302 under the force of gravity. FIG. 3B illustrates how the product 302 has accumulated at the first end 414 of the partially formed package 404*b*. A product settler 308 is actuated to cause the product 302 to settle into a more compact configuration as shown in FIG. 3C. As shown in FIG. 3B the product settler settles the product so that it requires less longitudinal space in the partially formed package 404*b*. For example, in one embodiment, before settling, the first end of a package is at a first-end product line 310 and the product is longitudinally distributed (e.g., in a longitudinal direction along central axis 334) in the package from the first-end product line 310 to an unsettled second-end product line 314 (e.g., unsettled level or height of the product). However, after settling, the product 302 settles to a settled second-end product line 312 (e.g., settled level or height of the product). Accordingly, the unsettled package film length 316 required for the unsettled product 302 is greater than the settled package film length 318 required for the settled product 302. For example, as shown in FIGS. 3A and 3B, the unsettled package film length 316 is the distance from the first-end product line 310 to the unsettled second-end product line 314 of the product 302. Similarly, the settled package film length 318 is the distance from the first-end product line 310 to the settled second-end product line 312 of the product 302. Although the settled and unsettled package film lengths indicate the length of film required for a column of product, the overall package length can be greater, for example, to accommodate folds, gussets, seals, and any desired head space.

In some embodiments, the settled package film length 318 required for settled product is about 0.5 to about 1.0 inches shorter than the unsettled package film length 316 required for unsettled product. Accordingly, in some embodiment, the settler can reduce overall package lengths for a product by about 0.5 to about 1.0 inches.

In some embodiments, the settler 308 settles product 302 while the product is falling. In other embodiments, the settler 308 settles product 302 after the product has fallen. In some embodiments, the settler 308 settles product 302 while the product is falling and after the product has fallen. In some embodiments, the settler 308 comprises a paddle (e.g., one of a plurality of paddles 320*a,b*) that rotates in a rotational direction 322 so that when the paddle contacts the film 202, the paddle pushes the film generally in the direction of conveyance 306 of the film.

Sixth, in a second end-sealing step 112, a second end seal 212*b* is formed on the partially formed package 404*b* to form a package 404*a*. The second end seal 212*b* is located on a second face of the package (e.g., second end 416 of the first package 404*a*). This can be seen, for example, in FIG. 2.

In the illustration shown in FIGS. 4A-4B, the first end seal 212*a* is approximately perpendicular to the longitudinal seal 402 (e.g., a back seal).

In one embodiment, the settling step 110 comprises the step of intermittently contacting the package (e.g., the partially formed second package 404*b* in FIG. 2) to move the package, thereby moving the product 302 in the package and causing the product to settle.

In one embodiment, the settling step further comprises the step of intermittently applying a force to the film (e.g., by impacting or contacting the film) that does not pause the conveyance of the film. For example, the component of the force that is opposed to the conveyance of the film is not sufficient to pause the conveyance of the film.

In one embodiment, the settling step 110 further comprises the steps of continuously or intermittently rotating a paddle wheel 326 that comprises a paddle (e.g., paddle 320*a* or paddle 320*b*). The paddle is rotated into contact with the package (e.g., second package 404*b* in FIG. 3A), thereby moving the product 302 inside the package. In addition to using a paddle wheel to intermittently contact the package film, other objects and mechanisms (e.g., a single bar that moves into and out of contact with the film) can also be used to intermittently contact the film.

In one embodiment, gas is directed into the partially formed package 404*b*. For example, some form, fill and seal machines 206 use pressurized gas to maintain positive pressure inside the package 404*b*. Such a machine can also be used in conjunction with the inventive settler. For example, when pressured gas is used, it can be directed in the fall direction 304 shown in FIG. 3A. The gas pressurizes the inside of the package 404*b*. This pressure provides some structural rigidity to the package 404*b* and provides resistance to the paddle (e.g., one of a plurality of paddles 320*a,b*) when the paddle impacts the film 202 of the package 404*b*. Upon impact, the paddle pushes the film 202 inward. However, after the impact, there is a period of time before the paddle again impacts the film. During the period of time between impacts, the pressure of the gas inside the package 404*b* provides a force (e.g., force 324 in FIG. 3B) to push the film 202 out before it is again impacted by a paddle 320*a,b*. The cycle of film being pushed in by impact from the paddle and the film being pushed out by the pressure from the gas causes the film to vibrate (e.g., shake or oscillate), which in turn, causes the product 302 inside the partially formed package 404*b* to settle (e.g., in a longitudinal direction along central axis 334). This cycle is shown with reference to the partially formed package 404*b* in FIGS. 3B-3C. Although, this cycle has been described in the context of using a pressurized gas to return the film to an original position after the film is deformed by impact, in other embodiments, the film may be sufficiently elastic to return to an original position even without using the pressurized gas.

In one embodiment, gas is directed (e.g., in the fill direction 304) into the package (e.g., partially filled second package 404*b* in FIG. 3A) in the form of a first jet of gas (e.g., air). In one embodiment, the first jet is directed into the package 404*b* intermittently. For example, in one embodiment, the first jet is activated 520 milliseconds after a first end seal is formed on the package. The first jet is active for 1465 milliseconds and then becomes inactive. Additionally, in one embodiment, a plurality of jets are directed into the package. For example, a second jet of gas (e.g., air) can be directed (e.g., in the fill direction 304) into the package 404*b*. In some embodiments, the second jet is directed into the package 404*b* intermittently. For example, in one embodiment, the second jet is activated 120 milliseconds after the first jet becomes inactive. The second jet is active for 1465 milliseconds and then becomes inactive.

In one embodiment, the paddle wheel 326 rotates continuously. In another embodiment, the paddle wheel 326 rotates intermittently. When the paddle wheel 326 rotates intermittently, the paddle (e.g. paddle 320*a* or paddle 320*b*) also rotates intermittently. In one embodiment, a paddle rotates intermittently in the sense that an actuator (e.g., motor 616 in FIGS. 6B-6C) continuously rotates the paddle for a first period of time (e.g., 1500 milliseconds and then the actuator is inactive for a second period of time (e.g., 750 milliseconds). In one embodiment, after the actuator 616 rotates the paddle, the actuator stops the paddle in a desired position (e.g., so that the paddle is not in contact with the film). In one embodiment, the actuator 616 actively accelerates the paddle to increase or decrease its angular velocity. In another embodiment, the actuator only actively accelerates the paddle to increase its angular velocity and the paddle is allowed to decelerate passively (e.g., due to frictional forces). In some embodiments, the paddle wheel rotates at about 600 to 700 revolutions per minute (rpm), at about 660 rpm, or at about 600 rpm.

One embodiment of the invention will now be described with reference to FIGS. 2, 3A-3C, 5A-5C, 6A-6C, and 7. For example, FIG. 2 depicts an apparatus comprising an improved product settler 308 for use with a continuous motion form, fill, and seal machine 206. The form, fill, and seal machine comprising a product conduit 204, a conveyor (e.g., pull belts 214*a,b*), and seal jaws 216*a-d*. The continuous motion form, fill and seal machine is continuous in the sense that a package film 202 is continuously conveyed along a product conduit 204. For example, the conveyor 214*a,b* is positioned to convey (e.g., positioned to contact) the package film 202 that is wrapped around the product conduit 204. The conveyor 214*a,b* continuously moves the package film 202 along the product conduit 204. The seal jaws 216*a-d* are positioned adjacent to opposite portions (e.g., faces 408, 406 in FIGS. 4A-4B) of the package film 202 to form a first end seal 212*a* on the package film when the seal jaws 216*a-d* move together and the package film is pressed between the seal jaws. This forms a first end seal 212*a* on a first face 414 of a package (e.g., partially formed second package 404*b*). The product conduit 204 is positioned so that a product (e.g., product 302 in FIGS. 3A-3C) passing through the product conduit will enter the package (e.g., second package 404*b*) after exiting the product conduit. The product conduit 204 is positioned higher than (e.g., above) the seal jaws 216*a-d*.

Figure 7:
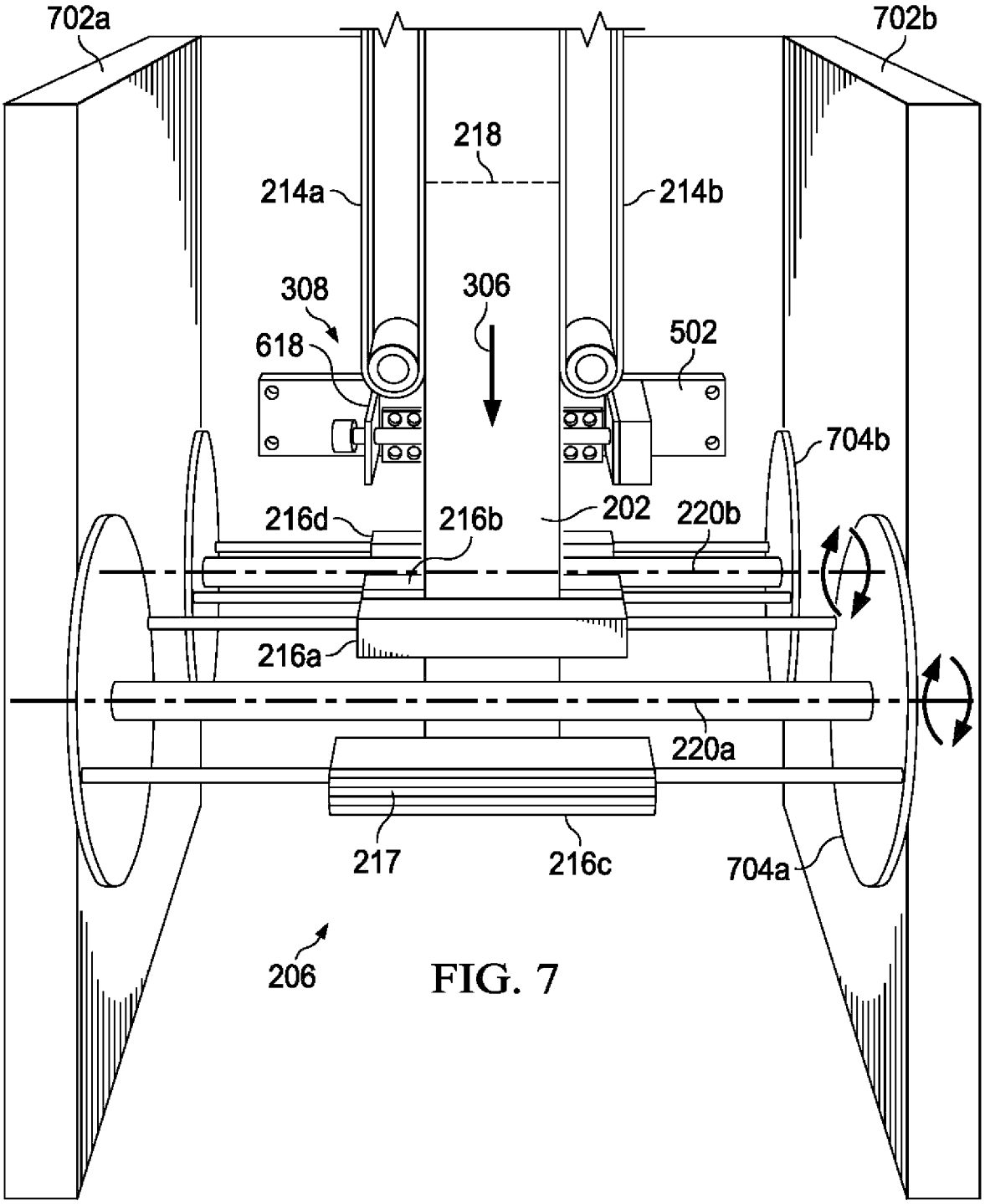
FIG. 7 is a schematic view of one embodiment of the invention for use with a vertical, form, fill, and seal machine.

As seen in FIG. 2 and FIG. 7, a first seal jaw 216*a* rotates around a first axis of rotation 220*a*, and a second seal jaw 216*b* rotates around a second axis of rotation 220*b*. Additionally, a third seal jaw 216*c* rotates around the first axis of rotation 220*a*, and a fourth seal jaw 216*d* rotates around the second axis of rotation 220*b*. As the first and second seal jaws 216*a,b* rotate, they come together to seal and cut the package film 202 (e.g., to form a first end seal 212*a* on the package film). As shown in FIG. 7, as the seal jaws rotate a sealing face 217 of each seal jaw 216*a-d* faces the package film 202 and the package film is pressed between seal jaws 216*a-d* to form a seal. Likewise, as the third and fourth seal jaws 216*c,d* rotate, they come together to seal and cut the package film 202 (e.g., to form a second end seal 212*b* on the package film). In some embodiments, for example, as shown in FIG. 2, a second end seal 212*b* for a first package 404*a* is formed simultaneously with a first end seal 212*a* for a second package 404*b*.

As shown in the embodiment of FIG. 7, the first seal jaw 216*a* and third seal jaw 216*c* are fixed to a first rotating seal jaw carriage 220*a*. Similarly, the second seal jaw 216*b* and fourth seal jaw 216*d* are fixed to a second rotating seal jaw carriage 220*b*. As shown in FIG. 2, the seal jaws 216*a-d* rotate in a direction 222*a,b* so that when the seal jaws 216*a-d* contact the package film 202, the seal jaws have a translational velocity that is generally parallel to a direction of conveyance 306 of the package film. This is advantageous as it permits the package film 202 to continuously move in the direction of conveyance while the seal jaws 216*a-d* seal and cut the package film 202 to form packages (e.g., package 404*a*). This is an example of a continuous form, fill and seal machine 206. In one embodiment, a form, fill and seal machine produces at least about 25 packages (e.g. package 404 or package 404*a*) per minute. In one embodiment, a form, fill and seal machine produces at least about 40 packages per minute.

Generally speaking, because the inventive settler does not pause a package film, the number of packages per minute that a machine produces with the inventive settler is greater than the number of packages per minute that a machine produces when using a conventional settler. For example, the speed at which packages of product are produced can depend on the speed at which a film is conveyed for forming a package, the speed at which the package is filled with product, and any pause in conveying the film that is required to settle a product. If a package can be filled with product faster than the film can be conveyed into position to form a package, the limiting factor for producing a package of product is the speed at which the film is conveyed. Furthermore, if film speed is the limiting factor for the rate at which packages of a product can be manufactured, pausing the film during the activation of a conventional settler will further reduce the number packages per minute produced. Thus, when film speed is the limiting factor for a machine's rate of package production and settling is desired, settling with the inventive settler will result in an increased rate of package production when compared to settling with a conventional settler.

Accordingly, the product settler 308 is especially useful in conjunction with continuous, form, fill and seal machines because the product settler does not require the package film 202 to stop in order to settle product 302 in the package film. Although the product settler 308 has been described with reference to a continuous form, fill and seal machine, the product settler can also be used with machines that intermittently advance the package film 202. An example is any form, fill and seal machine that that stops or pauses the film 202 of a package 404*a* while the package 404*a* is being formed. Although a partially formed package has been described with reference to a package that has been made on a form, fill and seal machine, this is only an illustrative example.

As another example, the product settler can be used to settle product in a package that is open. For example, a partially formed package can be an open package and the formed package can be the closed package. Although using a product settler on a package that is open, but otherwise formed, may not result in savings related to package materials (e.g., film or paper), it can still provide other benefits. For example, it can decrease the size of the package and reduce costs associated with shipping, including secondary packaging costs for items such as shipping crates.

With reference to FIGS. 3A-3C, a product settler 308 is positioned to agitate a product 302 in the package film 202. The product settler 308 comprises a first object (e.g., paddle 320*a,b*) positioned to cause an impact against the film 202. The impact agitates the film 202 and settles the product 302 from an unsettled height 314 to a settled height 312 while a form, fill and seal machine 206 continuously conveys the film along the product conduit 204. The impact against the film can be caused directly or indirectly by the first object.

An example of an object directly impacting the film is shown in FIGS. 3A-3C. As shown, the product settler 308 comprises a rotatable paddle wheel 326 and the paddle wheel comprises a paddle (e.g., one of a plurality of paddles 320*a,b*). The paddle is positioned so that, as the paddle wheel 326 rotates, the paddle causes agitation of the product 302 and thereby settles the product. In the example shown in FIGS. 3A-3C, the paddle intermittently contacts the package film 202 thereby causing agitation of the product 302.

In some embodiments, a first object (e.g., paddle 320*a*) is positioned to intermittently and directly contact the package film 202 and the first object thereby agitates the product 302. In other embodiments, the first object (e.g., paddle 320*a*) is positioned to intermittently and directly contact a second object (e.g., the product conduit 204), and the second object contacts the product film 202 and thereby agitates the product 302.

As shown in FIGS. 3B-3C, the product settler 308 can be positioned adjacent to a tube of film 202, below the product conduit 204, and above the unsettled second-end product line 314. For example, this can provide settling of a product without resulting in breakage of the product. The risk of breakage can be further reduced by running the product settler intermittently. For example, the product settler can be paused while product is falling and actuated after the product has fallen past the product settler.

In one embodiment, the package film 202 comprises an impact face (e.g., back side 406 in FIG. 4B). The impact face 406 is adjacent to the product settler 308, as shown, for example, in FIGS. 3A-3C. When the impact face 406 of the package film 202 hangs under the force of gravity (which as shown in FIGS. 3A-3C is the same as the direction of conveyance 306), the impact face defines a first position of the impact face (e.g., as shown in FIG. 3A). The settler 308 is positioned so that as the paddle (e.g., paddle 320*a*) rotates, a first tip 328 of the paddle will reach past the first position by a first distance 330. In one embodiment, as the paddle (e.g., paddle 320*a*) rotates, the first distance 330 reaches a maximum of about 1 inch. In one embodiment, the first distance 330 reaches a maximum of about 0.5 inch. In one embodiment, the ratio of the first distance to the diameter of the product conduit (e.g., former) is a maximum of about 0.041. In one embodiment, the ratio of the first distance to the diameter of the product conduit (e.g., former) is a maximum of about 0.143. In one embodiment, the settler 308 is positioned so that, as the paddle (e.g., paddle 320*a*) rotates, the paddle will first contact the package film 202 at a first point that is a second distance 332 below the product conduit 204. In some embodiments the second distance 332 is about 0.5 inch to about 3.6 inches.

In one embodiment, the settler 308 is used with a form, fill and seal machine that further comprises a source of pressurized gas (e.g., compressor 224). In one embodiment, the source of pressurized gas 224 comprises a nozzle 226 to direct the pressurized gas into the package film 202. In one embodiment, the source of pressurized gas 224 is selected from the group consisting of a fan, a blower, or a centrifugal compressor.

In one embodiment, pressurized gas is used to provide pressure on the inside of the package film 202. This can be useful when a package film is not resilient enough on its own to move out of a deformed position (e.g., the deformed position illustrated in FIG. 3B) that results when the settler 308 impacts the package film 202. When pressurized gas is used and the impact face 406 of the film 202 is not in a deformed position caused by the settler 308, the position of the impact face will be different from the position of the impact face when the inside of the package film is not under pressure. In other words, rather than being in a first position as illustrated in FIG. 3A, the impact face 406 will be in a second position that can be similar to the position illustrated in FIG. 3A, but can also be further from a central axis 334 of a package (e.g., package 404*b*).

As another example, in one embodiment, the package film 202 comprises an impact face 406 that is adjacent to the product settler 308. When the package film 202 is filled with the pressurized gas and hangs under the force of gravity, the impact face 406 defines a second position of the impact face. This position can be substantially similar to the first position of the impact face 406 described with reference to FIG. 3A. However, when the impact face 406 is in the second position, the package film 202 is filled with a pressurized gas, and the pressure from the gas can push the surface of the package film, including the impact face 406, outward. Accordingly, the second position of the impact face 406 can be located further away from a central axis 334 of a package (e.g., the second package 404*b*) than the first position of the impact face. In one embodiment, the settler 308 is positioned so that as the paddle (e.g., paddle 320*a*) rotates, a first tip 328 of the paddle will reach past the second position of the impact face 406 by a third distance. The third distance can be substantially the same as the first distance 330 shown in FIG. 3B. However, the third distance can also be greater than the first distance 330 when the second position of the impact face 406 is further from the central axis 334 than the first position of the impact face 406. In one embodiment, as the paddle (e.g., paddle 320*a*) rotates, the third distance reaches a maximum of about 2.5 inches. In one embodiment, the ratio of the third distance to the diameter of the product conduit (e.g., former) is a maximum of about 0.041. In one embodiment, the ratio of the third distance to the diameter of the product conduit (e.g., former) is a maximum of about 0.208.

For example, in one embodiment, the distance from the first tip 328 of a paddle 320*a* to the axle 602 of a paddle wheel 326 is about 2.5 inches and the axle of the paddle wheel is positioned about 0.5 inches from the impact face 406 of a package 202. Accordingly, when the paddle 320*a* rotates, the first tip 328 reaches past the original position of the impact face 406 by about 2.0 inches and the third distance is about 2.0 inches.

In one embodiment of an apparatus according to the invention, a package film 202 is wrapped around the product conduit 204. The apparatus can comprise a plurality of conveyors 214*a,b* positioned to convey the package film 202 along the product conduit 204 at substantially a single speed along a perimeter 218 of the packaging film. The product conduit 204 is selected, for example, from the group consisting of a tube, a chute, a duct, and a pipe.

Figure 5A:
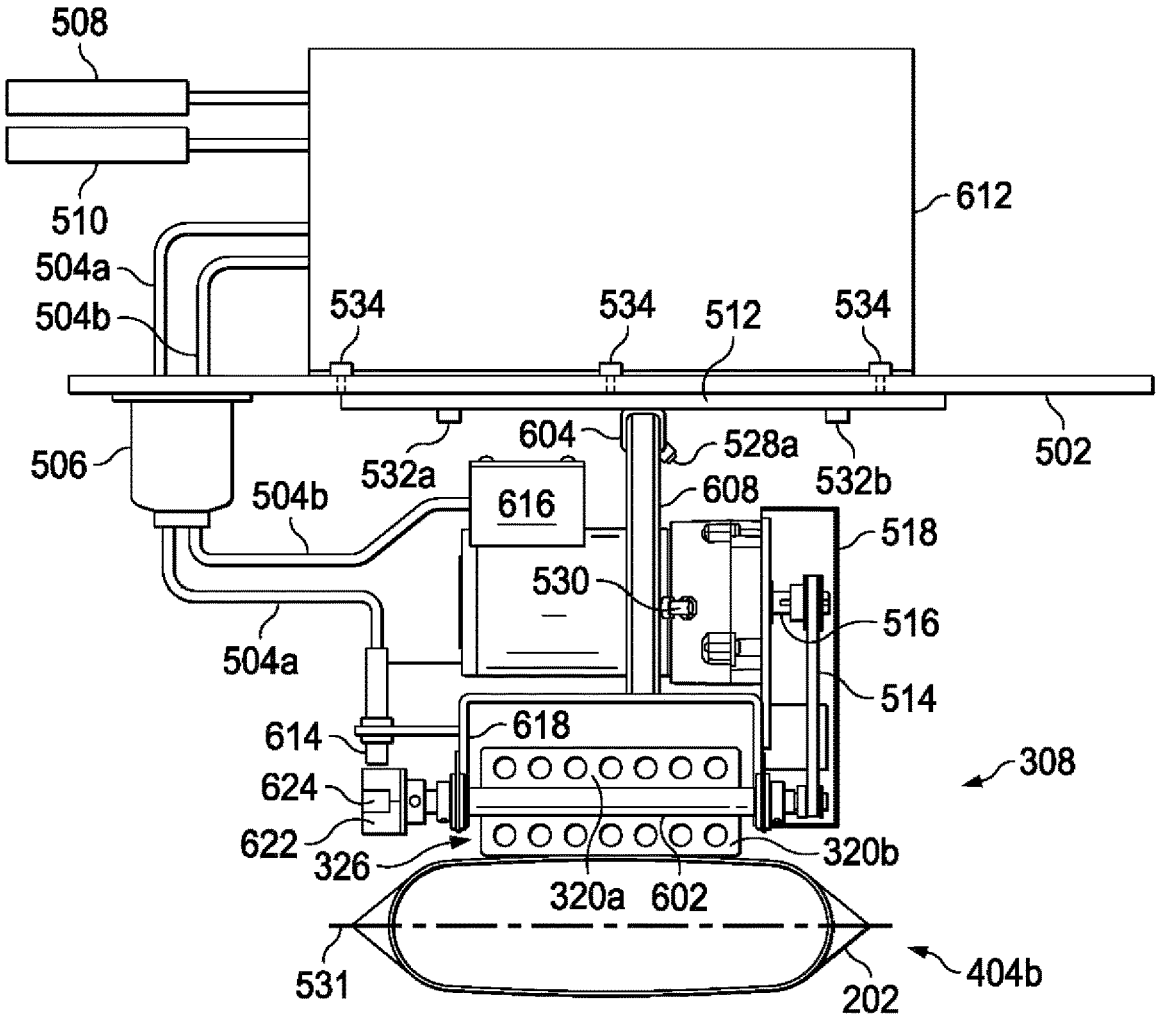
FIG. 5A is a schematic top view of one embodiment of the invention.

In one embodiment illustrated in FIG. 5A the apparatus is a form, fill and seal machine that comprises a positional sensor 614 to determine the position of the paddle wheel 326. For example, in one embodiment, the machine comprises a product settler 308 and the product settler comprises the positional sensor 614.

The positional sensor 614 can be, for example, a camera or electromagnetic device. The positional sensor 614 can also be a proximity switch. For example, in one embodiment, the positional sensor 614 senses the presence or absence of a sensor target 622 (e.g., a magnet) within a given range of the positional sensor. In another embodiment, the positional sensor 614 senses a distance from the positional sensor 614 to the sensor target 622. For example, the sensor target 622 can move (e.g. rotate) with the paddle wheel 326 so that the position of the sensor target indicates the position of the paddle wheel. In another example, the position of a portion 624 (e.g., a magnet or discontinuity) of the sensor target indicates the position of the paddle wheel 326.

In one embodiment, the positional sensor 614 is used to position the paddle wheel 326 or a paddle (e.g., paddle 320*a*). For example, when the paddle wheel 326 is stopped, the paddle wheel can be stopped outside the path of a package film 202. This can be desirable because if the paddle wheel 326 is stopped in the path of the package film 202, the paddle wheel 326 will increase the resistance that must be overcome to convey the package film.

Figure 6A:
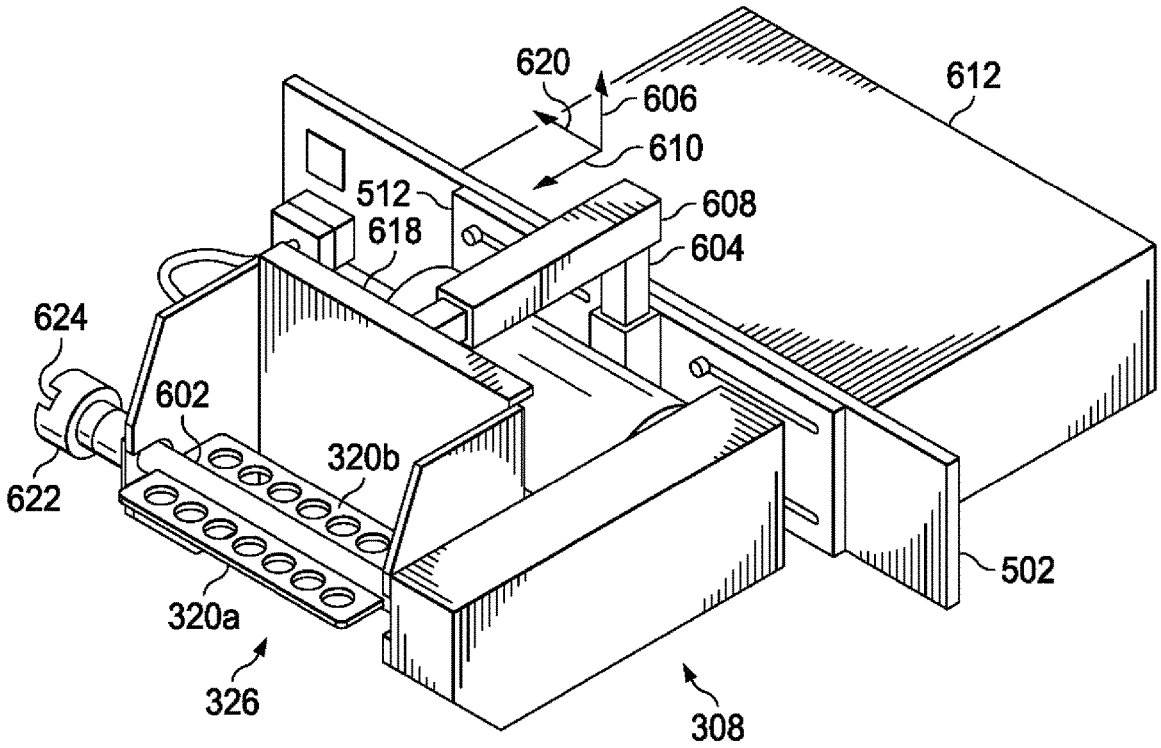
FIGS. 6A-6C are schematic perspective views depicting one embodiment of a product settler.
Figure 6B:
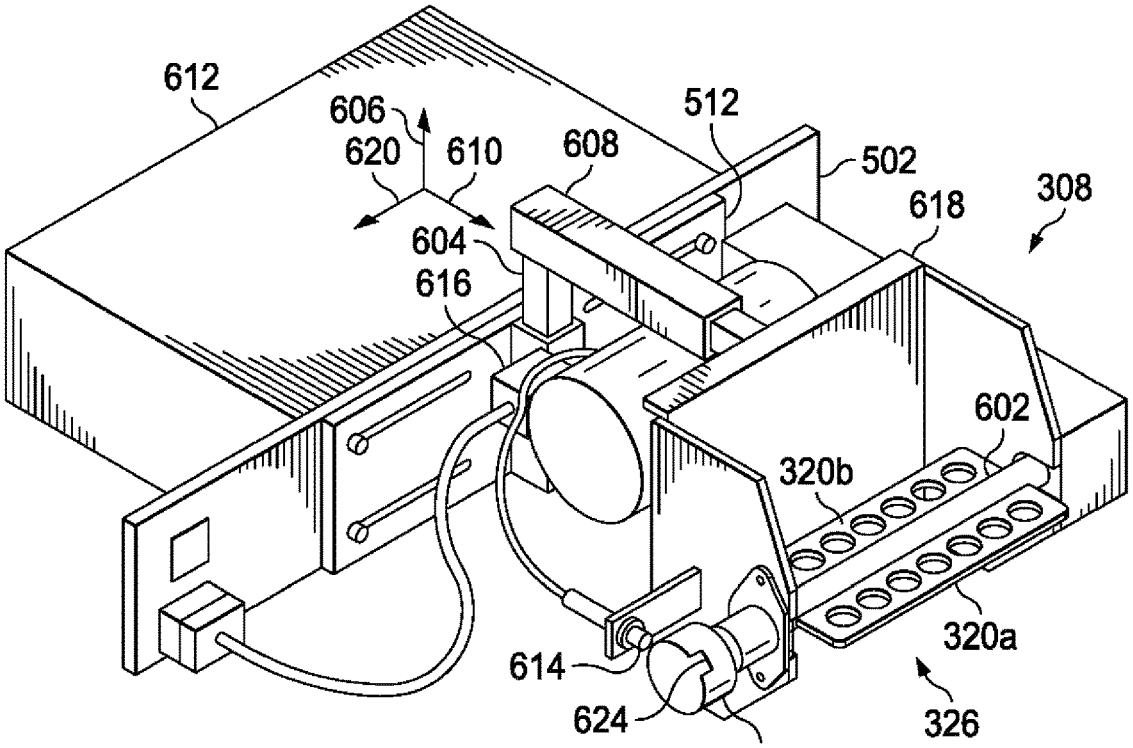

One embodiment of the invention will now be described with reference to FIGS. 6A-6B. A settler 308 comprises a paddle wheel 326. The paddle wheel 326 comprises a plurality of paddles (e.g., paddles 320*a,b*). The paddles 320*a,b* rotate around an axle 602. As shown in FIGS. 6A and 6B the paddles 320*a,b* are fixed to the axle 602, although in other embodiments the paddles 320*a,b* are not fixed to the axle directly, but are instead fixed to another component that rotates around the axle.

Figure 6C:
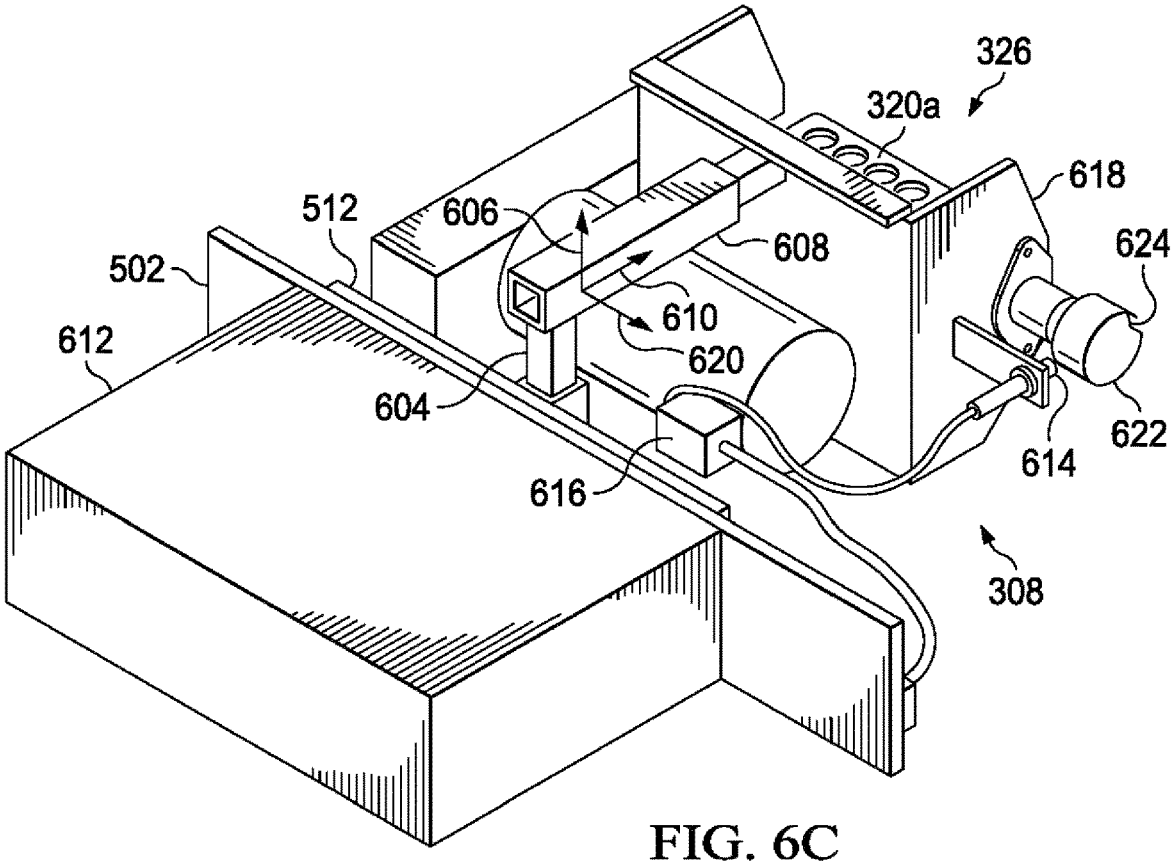

As shown, for example, in FIG. 6C, the product settler 308 comprises a first adjustable mount 604 to adjust the position of the product settler in a first direction 606. The product settler 608 comprises a second adjustable mount 608 to adjust the position of the product settler in a second direction 610. As shown in FIG. 6B, the product settler 608 also comprises a third adjustable mount 512 to adjust the position of the product settler in a third direction 620.

With reference to FIG. 6B, the product settler 308 comprises a controller 612 to set the number of impacts against the package film that the product settler causes. For example, the number of impacts per minute can be calculated by multiplying the number of paddle wheels by the number of rotations or revolutions per minute that the paddle wheel 326 performs. Although, if another object is used to impact the package film, for example, a rod that oscillates into and out of contact with the package film, the number of impacts per minute will need to be calculated differently. For example, one end of the rod can be fixed to a rotating sphere and the other end of the rod can follow an orbital pattern into or out of contact with the package. As another example, the rod can move linearly back and forth between two positions, for example, a first position in contact with the package film and a second position remote from the package film. Regardless of the mechanism used to cause an impact, in some embodiments the number of impacts against a package or package material is greater than about 180 impacts per minute, about 240 impacts per minute, about 300 impacts per minute, about 360 impacts per minute, about 420 impacts per minute, about 480 impacts per minute, about 540 impacts per minute, about 600 impacts per minute, or about 660 impacts per minute. In some embodiments, the number of impacts per minute is about 300 impacts per minute to about 900 impacts per minute. In some embodiments, the number of impacts is about 540 impacts per minute to about 720 impacts per minute. In some embodiments, the number of impacts is about 600 impacts per minute to about 660 impacts per minute.

Turning back to FIG. 6B, the illustrated product settler also comprises a positional sensor 614 (e.g., proximity switch) to determine the position of the paddle (e.g., paddle 320*a*). In one embodiment, the controller 612 uses information from the positional sensor 614 to instruct the actuator 616 to stop the paddle (e.g., paddle 320*a*) when the paddle is in a desired position.

As can be seen in FIG. 6C, the product settler 308 comprises a motor 616 with sufficiently low torque that if the motor turns off while the paddle (e.g., paddle 320*a*) is contacting the package film 202, as the package film is conveyed, the package film will push the paddle out of the path of the package film. Although the benefits of using a low torque motor have been described with respect to turning off the motor, the similar benefits will be realized if the product settler fails or loses power. In one embodiment, the settler is powered by a small AC/DC drive motor that will rotate the paddle wheel. For example, in one embodiment the actuator (e.g., motor) for the inventive settler requires a maximum of 96 Watts to settle product.

As shown in FIGS. 6A-6C and FIGS. 5A-5C, the product settler 308 comprises a frame 618 that fixes the position of the product settler 608 in relation to the path of the package film 202. For example, as shown in FIG. 5A, the product settler 608 is adjacent to a package 404*b*. The package 404*b* extends on both sides of a center plane 531 that is oriented parallel to a central axis (e.g., central axis 334 in FIGS. 2 and 3A-3C) of the package 404*b*. In some embodiments the frame 618 comprises adjustable mounts (e.g., the first adjustable mount 604, the second adjustable mount 608, and/or the third adjustable mount 512) to facilitate changing the position of the product settler 308 relative to the form, fill and seal machine 206. For example, in one embodiment, the adjustable mounts 604, 608, 512 can be used to move adjust the position of the product settler 308 in one, two, or three directions. For example, the first adjustable mount 604, second adjustable mount 608, and third adjustable mount 512 can be used to move or adjust the position of the product settler 308 in a first direction 606, second direction 610, or third direction 620, respectively. In one embodiment, the adjustable mounts 604, 608, 512 can be used to move or adjust the position of the product settler 308 in a plurality of mutually perpendicular directions (e.g., two or three). In other embodiments, the frame 618 does not comprise the adjustable mounts 604, 608, 512 and the frame is positioned in a desired location when it is installed on a form, fill and seal machine 206.

Figure 5B:
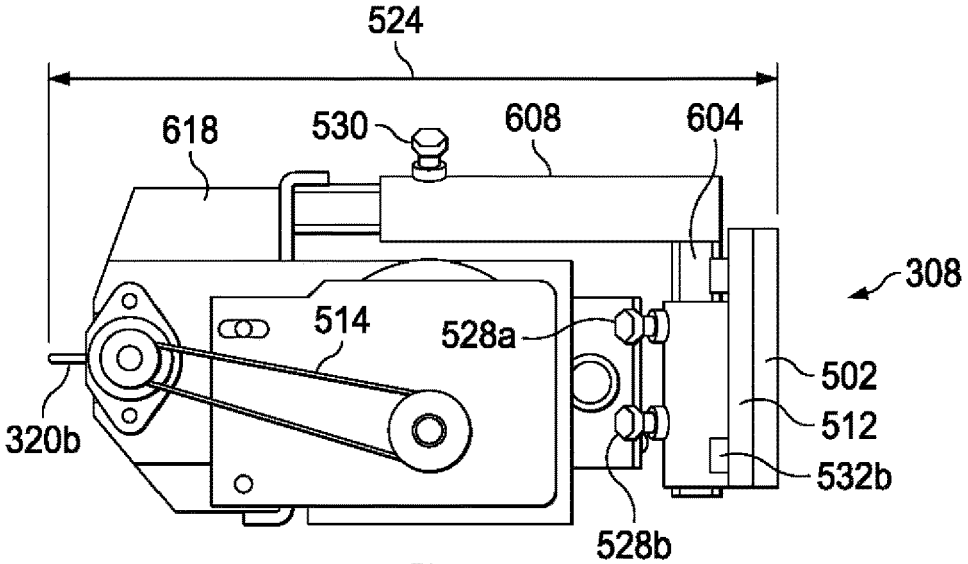
FIG. 5B is a schematic side view of the embodiment shown in FIG. 5A.
Figure 5C:
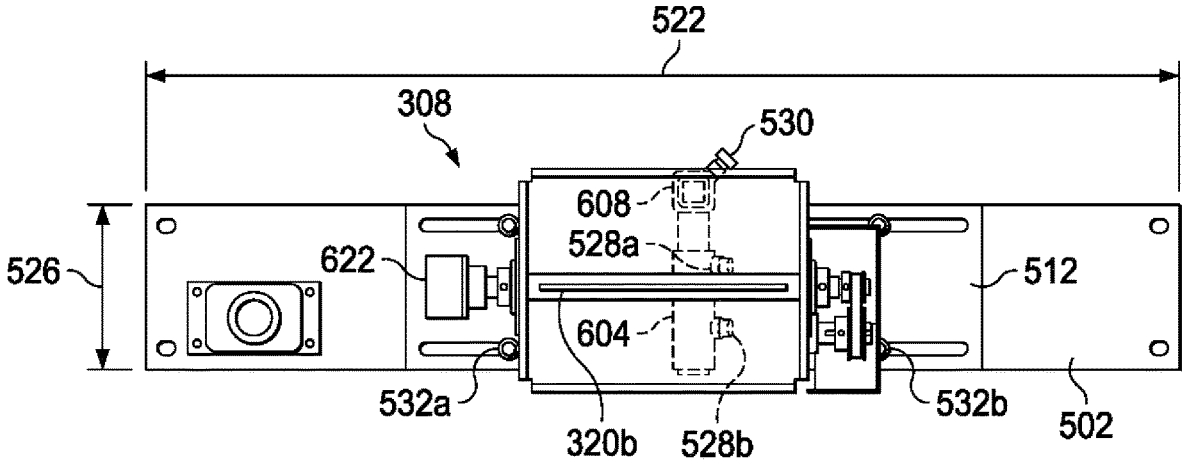
FIG. 5C is a schematic front view of the embodiment shown in FIG. 5A.

As shown in FIGS. 5A-5C, the first adjustable mount 604 comprises a first mechanism (e.g., bolts 528*a,b*) to fix the product settler 308 in a desired vertical position relative to the form, fill, and seal machine 206. The second adjustable mount 608 comprises a second mechanism (e.g., bolt 530) to fix the product settler 308 at a desired proximity to the form, fill, and seal machine 206. The third adjustable mount 512 comprises a third mechanism (e.g., bolts 532*a,b*) to fix the product settler 308 in a desired horizontal position relative to the form, fill, and seal machine 206.

One embodiment of the invention will now be described with reference to FIGS. 5A-5C and FIG. 8. As shown, the product settler 308 is modular. For example, besides connecting the product settler 308 to a form, fill, and seal machine, no assembly is required for the product settler. Accordingly, in one embodiment, the product settler 308 is operable after being electronically connected to a power source and placed in a desired position relative to the form, fill and seal machine 206. In one embodiment, this is accomplished by mounting a module in the form of a product settler 308 on the form, fill and seal machine 206 using a machine mount 502. For example, the machine mount 502 can connect the frame 618 of the product settler 608 (see, e.g., FIGS. 5A-5C) to the frame 702*a,b* of the form, fill and seal machine 206 (see, e.g., FIG. 7). In one embodiment, the machine mount 502 is fixed to controller 612 using a mechanism 534 such as screws or bolts (see, e.g., FIGS. 5A-5C). The same mechanism 534 or an additional mechanism can also be used to fix the machine mount 502 to the form, fill and seal machine 206.

In one embodiment shown in FIGS. 5A-5C, a modular product settler 308 is linked to a form, fill, and seal machine through a line of communication (e.g., one of a plurality of lines of communication 504*a,b*). The line of communication can be electronic, pneumatic, or some other manner of conveying power and/or information. For example, a line of communication (e.g., 504*a,b*) can provide an electronic line of communication between the product settler 308 and the form, fill and seal machine 206. In turn, the form, fill and seal machine 206 can provide a power source 508 for the product settler 308. Although, the product settler 308 can also be connected to a power source 508 (e.g., power outlet or battery) that is separate from the form, fill and seal machine 206. Similarly, a line of communication (e.g., 504*a,b*) can connect the product settler 308 to a controller 612 for the product settler. In turn, the controller 612 can be used to control the position of the paddle wheel 326 in conjunction with a positional sensor 614. Furthermore, the controller 612 can be used to control the angular velocity or rotational speed of the paddle wheel 326. In some embodiments, a plug 506 is provided to facilitate connecting and disconnecting a line of communication between the product settler 308 and a component (e.g. the controller 612) or the form, fill and seal machine 206. In some embodiments, the line of communication between the product settler 308 and the form, fill and seal machine 206 goes through the controller 612. In some embodiments, the controller 612 for the product settler 308 is in communication with the form, fill and seal machine 206 through an auxiliary port 510 of the form, fill and seal machine 206. Accordingly, in some embodiments a line of communication (e.g., 504*a,b*) exists between the form, fill and seal machine 206 and the product settler 308 so that a control system of the form, fill and seal machine 206 can be used to control the controller 612 of the product settler 308, and thereby control the product settler 308.

The product settler 308, shown in FIGS. 5A-5C also comprises a timing belt 514 which is used to actuate the product settler 308. The timing belt 514 is wrapped around a rotor 516 and an axle 602. When that the rotor 516 is rotated by motor 616, it causes the timing belt 514 to travel around the axle 602. This, in turn, causes the axle 602 to rotate, which rotates the paddle wheel 326.

In the embodiment shown in FIGS. 5A-5C, the product settler 308 comprises a timing belt guard 518. The timing belt guard protects the timing belt from being caught on an object, for example, product 302 or film 202. Similarly, as shown in FIGS. 6A-6C, the frame 618 of the product settler 308 can comprise a paddle guard that protects the paddle (e.g., on one side or a plurality of sides) from being obstructed by objects other than the package film 202.

As can be seen in FIG. 7, the product settler 308 is unobtrusive. The product settler is fairly small, lightweight, and located to one side of the seal jaw carriage 704*a,b* so it does not obstruct access to the carriage for repair or maintenance. For example, as shown in FIGS. 5B-5C, one embodiment of the product settler has a length 522 of about 24 inches, a width 524 of about 16, and a height 526 of about 8 inches. In some embodiments, the product settler has a length 522 of about 6 to about 30 inches, a width 524 of about 6 to about 30 inches, and a height 526 of about 4 to about 12 inches. In one embodiment, the product settler, excluding the machine mount 502 and third adjustable mount 512, weighs a maximum of about 12 lbs. In comparison, conventional product settlers, excluding mounting plates, typically weight about 50 lbs.

Additionally, the product settler can be easily installed or uninstalled. For example, with reference to the embodiment shown in FIGS. 5A-5C, a portion of the product settler can be uninstalled by removing a plug 506 and detaching the portion from the machine mount 502, which can be left attached to a form, fill, and seal machine 206. Alternatively, the machine mount 502 can be detached from the form, fill and seal machine 206. This can be done without (or in addition to) removing the plug 506 and detaching a portion of the product settler 308 from the machine mount 502.

Although the inventive product settler has been described by reference to use of a package made from film. The package material can be made from a film or some other form of material. For example, the inventive settler can be used with packages made from package materials of varying thicknesses. Furthermore, the package material can be, for example, paper, metal, metal oxides, polymer, or some combination thereof.

EXAMPLES

Illustrative examples of the inventive settler and experiments involving the inventive settler will now be described.

Example 1

An experiment was conducted to measure certain benefits of using the inventive product settler 308 described herein. A continuous motion vertical form, fill and seal machine 206 was fitted with the inventive settler 308. Then, the machine 206 was used to produce 13.0 oz packages 202 containing TOSTITOS® Restaurant Style Tortilla Chips. The machine 206 ran at a speed of about 26 packages per minute. The packages 202 were produced on a product conduit 204 (e.g., former) with a circular cross-section. The cross-section of the product conduit 204 had a diameter of about 10.5 inches, and accordingly the packages 202 had a diameter of about 10.5 inches while wrapped around the product conduit. The packages 202 had a length of about 15.75" from the tip of a first end seal 212*a* to the opposite tip of a second end seal 212*b*. Each end seal 212*a,b* was approximately ⅜ inches long providing a total usable package length of about 15 inches. In other words, the length of the package 202 that could be filled with product was approximately 15 inches.

A first set of five packages 202 were produced on a machine 206 without using the inventive settler 308. The average package head space was about 1.3 inches and the average unsettled height 314 of the product was about 13.7 inches. A second set of five packages 202 were produced on the machine 206 with the inventive settler 308 activated. Using this set up, the average package head space was about 2.9 inches and the average settled height 312 of the product was about 12.1 inches. As can be seen, the inventive settler resulted in an average settling of about 1.6 inches, which is a settling fraction of at least about 0.116 relative to the unsettled height 314 of the product.

Additionally, the inventive settler reduced the average length of film required to package each unit of product by about 1.6 inches. For example, rather than increasing the head space in a package, the product settler could also have been used to maintain a given head space while decreasing the length of film required for the package. In this example, the length of film required to package each unsettled unit of product was 15.75 inches. Since the product settler resulted in settling of about 1.6 inches, the product settler could have reduced the length of film required by 1.6 inches. This is a film reduction fraction of at least 0.101 relative to the length of film required if no settler is used.

Breakage of product occurring with and without the inventive settler activated was substantially the same. The use of the inventive settler did not result in any statistically significant increase in the ratio of broken product to non-broken product in a package. In other words, any increase in breakage was within the margin of error for the experiment.

Table 1

Table 1 provides speeds in packages per minute at which an illustrative form, fill and seal machine can produce packages with a clamp on. All information in the table corresponds to a seal time of 70 milliseconds. In other words, the seal jaws press against the film for approximately 70 milliseconds to form package end seals. The table shows how package production speeds vary with bag length. As can be seen, increased package lengths result in lower package production speeds. This is because, given a fixed speed for conveying packages, longer packages require more time to be convey.

TABLE 1

| Package length (inches) | Production Speed (packages/minute) |
|---|---|
| 27.99 | 19 |
| 27.5 | 19 |
| 27 | 19 |
| 26.5 | 19 |
| 26 | 20 |
| 25.5 | 20 |
| 25 | 21 |
| 24.5 | 21 |
| 24 | 22 |
| 23.5 | 22 |
| 23 | 23 |
| 22.5 | 23 |
| 22 | 24 |
| 21.5 | 24 |
| 21 | 25 |
| 20.5 | 25 |
| 20 | 26 |
| 19.5 | 27 |
| 19 | 27 |
| 18.5 | 28 |
| 18 | 29 |
| 17.5 | 30 |
| 17 | 31 |
| 16.5 | 32 |
| 16 | 33 |
| 15.5 | 34 |
| 15 | 35 |

Although the inventive settler is described herein as being installed on specific embodiments of vertical form, fill, and seal machines, the inventive settler is not limited to being used with these machines. Rather, the inventive settler can be used, for example, with essentially any process where a product can be settled in a package. Although, the inventive settler is especially useful with processes where a film is being continuously advanced to form a package that is filled with product and then sealed. When used with such a process, the inventive settler can settle product within the film while the film is being continuously advanced. This is a substantial improvement over conventional settlers that require a film to pause intermittently for settling.

Additionally, while the product settler has generally be described in the form of a paddle wheel, some embodiments of the product settler for use with a form, fill and seal machine are also possible. For example, the product settler can be in the form of an object such as a rod that is positioned and actuated to intermittently impact a partially formed package and thereby settle product in the package. In some embodiments, the object can provide settling by contacting the partially formed package on one and only one face. In some embodiments, the object impacts the partially formed package more than 300 times per minute. In some embodiments, the object impacts the partially formed package more than 600 times per minute.

Furthermore, while the steps for particular embodiments of the invention have been described herein, a person skilled in the art would understand from the disclosure that the steps can be modified. For example, as appropriate, steps can occur at different times, steps can occur simultaneously or sequentially, the order of steps can be swapped or varied, certain steps can overlap even if they start at different times, and steps can be added or removed.

While this invention is particularly shown and described herein with reference to preferred embodiments, it will be understood by those skilled in the art that various changes in form and detail can be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the elements described herein, in all possible variations thereof, is encompassed by the invention unless otherwise indicated herein or otherwise clearly contradicted by context. For example, various advantages of the invention can still be realized if additional elements are added to provide additional advantages or if certain elements are omitted because a particular feature is unnecessary or undesirable for a given application.

ADDITIONAL DISCLOSURE

The following clauses are offered as further description of the disclosed invention.

1. A method for settling a product in a package made on a form, fill and seal machine, the method comprising the steps:
   a. providing a package material on a product conduit of a form, fill and seal machine;
   c. forming a first end seal on the package material to form a partially formed package;
   d. filling the partially formed package with the product; and
   e. settling the product in the partially formed package while continuously conveying the package material along the product conduit.

2. The method of clause 1 further comprising the step:
   f. forming a second end seal on the partially formed package to form a package from the partially formed package.

3. The method of clause 1 further comprising the step:
   b. sealing the package material to form a longitudinal seal.

4. The method of clause 3, wherein the first end seal is approximately perpendicular to the longitudinal seal.

5. The method of clause 1, further comprising the step:
   directing a gas into the partially formed package.

6. The method of clause 5, wherein the gas is directed into the partially formed package as a first jet of gas.

7. The method of clause 5, wherein the gas pressurizes an interior of the partially formed package.

8. The method of clause 1, wherein the settling step further comprises the steps:
   pressurizing an interior of the partially formed package to provide resistance; and
   intermittently contacting the partially formed package to move the partially formed package, thereby moving the product.

9. The method of clause 1, wherein the settling step further comprises the steps:
   rotating a paddle wheel comprising a paddle;
   intermittently rotating the paddle into contact with the partially formed package, thereby moving the product while the product is inside the partially formed package.

10. The method of clause 9, wherein an actuator rotates the paddle and stops the paddle in a desired position.

11. The method of clause 1 wherein the package material is a film.

12. An improved continuous motion form, fill and seal machine, said machine comprising a product conduit, a conveyor, and seal jaws; wherein the conveyor is positioned to convey a package material that is wrapped around the product conduit; wherein the conveyor moves the package material along the product conduit; wherein the seal jaws are positioned adjacent to opposite portions of the package material to form a first end seal on the package material, thereby forming a partially formed package; wherein the product conduit is positioned so that a product passing through the product conduit will enter the partially formed package after exiting the product conduit; and wherein the product conduit is positioned above the seal jaws; wherein the improvement comprises:
   a product settler comprising a first object positioned to cause an impact against the package material;
   wherein the impact agitates the package material and settles the product from an unsettled height to a settled height while the machine continuously conveys the package material along the product conduit.

13. The machine of clause 12, wherein the machine comprises a source of pressurized gas.

14. The machine of clause 13, wherein the machine comprises a nozzle to direct the pressurized gas into the package material.

15. The machine of clause 12, wherein the product settler comprises a controller to set a number of impacts per minute that the first object causes on the package material.

16. The machine of clause 12, wherein the product settler comprises a positional sensor to determine a position of the first object.

17. The machine of clause 12, wherein the impact occurs on one and only one face of the partially formed package.

18. The machine of clause 12, wherein the first object directly contacts the package material to cause the impact.

19. The machine of clause 12, wherein the impact against the package material occurs below the product conduit and above the unsettled height.

20. The machine of clause 12, wherein the product settler comprises a motor with sufficiently low torque that if the motor turns off while the first object is in contact with the package material, as the package material is conveyed, the package material will push the first object out of a path of the package material.

21. The machine of clause 12, wherein the product settler is modular.

22. The machine of clause 12, wherein the product settler comprises a frame that spatially fixes the product settler in relation to a path of the package material.

23. The machine of clause 12, wherein the product settler comprises a first adjustable mount to move the product settler in a first direction.

24. The machine of clause 12, wherein the settler is positioned so that, as the first object moves into contact with the package material, the first object will first contact the package material at a first point that is a second distance below the product conduit.

25. The machine of clause 12, wherein the product settler is positioned adjacent to the package material so that, as the first object moves into contact with the package material, the first object will contact the package material below the product conduit and above the unsettled height of the product.

26. The machine of clause 12:
- wherein the seal jaws comprise a first seal jaw and a second seal jaw;
- wherein the first seal jaw rotates around a first axis of rotation;
- wherein the second seal jaw rotates around a second axis of rotation;
- wherein the first seal jaw, the first axis of rotation, the second seal jaw and the second axis of rotation are positioned so that, as the first seal jaw and the second seal jaw rotate, the first seal jaw and the second seal jaw come together to form the first end seal.

27. The machine of clause 12:
- wherein the seal jaws comprise a third seal jaw and a fourth seal jaw;
- wherein the third seal jaw rotates around a first axis of rotation;
- wherein the fourth seal jaw rotates around a second axis of rotation;
- wherein the third seal jaw, the first axis of rotation, the fourth seal jaw and the second axis of rotation are positioned so that, as the third seal jaw and the fourth seal jaw rotate, the third seal and the fourth seal jaw come together to form a second end seal on the package material thereby forming a package.

28. The machine of clause 12, wherein the package material is a film.

29. The machine of clause 12, wherein the machine is a vertical form, fill and seal machine.

30. The machine of clause 12:
- wherein the first object is a rotatable paddle wheel;
- wherein the paddle wheel comprises a paddle; and
- wherein the paddle is positioned so that, as the paddle wheel rotates, the paddle causes agitation of the package material and thereby settles the product.

31. The machine of clause 30:
- wherein the package material comprises an impact face;
- wherein the impact face is adjacent to the product settler;
- wherein, when the impact face of the package material hangs under a force of gravity, the impact face defines a first position;
- wherein the settler is positioned so that as the paddle wheel rotates, a first tip of the paddle will reach past the first position by a first distance; and
- wherein the first distance reaches a maximum of about 2.5 inches while the paddle wheel rotates.

32. The machine of clause 30, wherein the paddle wheel comprises a plurality of paddles.

33. A method for settling a product in a partially formed package, the method comprising the steps:
- a. providing a partially formed package;
- b. filling the partially formed package with a product; and
- c. settling the product in the partially formed package;
- wherein the settling step comprises:
  - rotating a paddle wheel comprising at least one paddle against the partially formed package.

34. The method of clause 33, further comprising the step:
- g. closing the partially formed package to form a package.

35. The method of clause 33, further comprising the step:
- h. directing a pressurized gas into the partially formed package.

36. The method of clause 33, wherein the paddle wheel rotates intermittently.

37. The method of clause 33, wherein the paddle wheel rotates continuously.

38. The method of clause 33, wherein the at least one paddle intermittently contacts the partially formed package.

39. The method of clause 33, wherein the partially formed package is provided on a form, fill and seal machine that intermittently conveys a package material along a product conduit.

40. The method of clause 33, wherein the partially formed package is provided on a form, fill and seal machine that continuously conveys a package material along a product conduit.

41. The method of clause 33, wherein the providing step further comprises the steps:
- i. providing a package material on a product conduit of a form, fill and seal machine;
- iii. forming a first end seal on the package material to form the partially formed package.

42. The method of clause 41, wherein the providing step further comprises the step:
- ii. sealing the package material to form a longitudinal seal.

43. The method of clause 41, further comprising the step:
- f. forming a second end seal on the partially formed package to form a package from the partially formed package.

44. The method of clause 33, further comprising the step:
- e. settling the product in the partially formed package while continuously conveying a package material along a product conduit.

45. The method of clause 42:
- wherein the first end seal is approximately perpendicular to the longitudinal seal.

46. An apparatus comprising an improved product settler for settling product in a partially formed package; wherein the improved product settler comprises:
- a paddle wheel;
- wherein the paddle wheel comprises at least one paddle that is positioned to cause an impact against the partially formed package;
- wherein the impact agitates the partially formed package and thereby settles the product.

47. The apparatus of clause 46, wherein the apparatus further comprises a source of pressurized gas.

48. The apparatus of clause 47, wherein the apparatus comprises a nozzle to direct the pressurized gas into the partially formed package.

49. The apparatus of clause 46, wherein the product settler comprises a controller to set a number of impacts per minute that the paddle wheel causes on the partially formed package.

50. The apparatus of clause 46, wherein the product settler comprises a positional sensor to determine the position of the paddle wheel.

51. The apparatus of clause 46, wherein the apparatus comprises a positional sensor to determine the position of the paddle wheel.

52. The apparatus of clause 46, wherein the impact occurs on one and only one face of the partially formed package.

53. The apparatus of clause 46, wherein the paddle wheel directly contacts the partially formed package to cause the impact.

54. The apparatus of clause 46, wherein the product settler comprises a motor with sufficiently low torque that if the motor turns off while the paddle wheel is in contact with the partially formed package, as the partially formed package is conveyed, the partially formed package will push the paddle wheel out of a path of the partially formed package.

55. The apparatus of clause 46, wherein the product settler is modular.

56. The apparatus of clause 46, wherein the product settler comprises a frame that spatially fixes the product settler in relation to a path of the partially formed package.

57. The apparatus of clause 46, wherein the product settler comprises a first adjustable mount to move the product settler in a first direction.

58. The apparatus of clause 46, wherein the paddle wheel comprises a plurality of paddles.

59. The apparatus of clause 46, wherein the apparatus comprises a form, fill and seal machine.

60. The apparatus of clause 46, wherein the apparatus comprises a form, fill and seal machine that advances film continuously along a product conduit.

What is claimed:

1. An apparatus comprising an improved product settler for settling product in a partially formed package; wherein the product settler comprises:

a paddle wheel;

wherein the paddle wheel comprises at least one paddle that is positioned and configured to cause an impact against the partially formed package above an unsettled height of the product in the partially formed package; and wherein the impact agitates the partially formed package and thereby settles the product;

wherein the product settler is configured so that the impact against the partially formed package settles the product from the unsettled height to a settled height of the product in the partially formed package, wherein the settled height is lower than the unsettled height.

2. The apparatus of claim 1, wherein the apparatus comprises a source of pressurized gas.

3. The apparatus of claim 2, wherein the apparatus comprises a nozzle configured to direct the pressurized gas into the partially formed package.

4. The apparatus of claim 1, wherein the product settler comprises a controller configured to set a number of impacts per minute that the paddle wheel causes on the partially formed package.

5. The apparatus of claim 1, wherein the product settler comprises a positional sensor configured to determine a position of the paddle wheel.

6. The apparatus of claim 1, wherein the apparatus comprises a positional sensor configured to determine a position of the paddle wheel.

7. The apparatus of claim 1, wherein the impact occurs on one and only one face of the partially formed package.

8. The apparatus of claim 1, wherein the paddle wheel is configured to directly contact the partially formed package to cause the impact.

9. The apparatus of claim 1, wherein the product settler comprises a motor, and wherein the product settler and the motor are configured and wherein the motor has sufficiently low torque so that if the motor turns off while the paddle wheel is in contact with the partially formed package, as the partially formed package is conveyed, the partially formed package will push the paddle wheel out of a path of the partially formed package.

10. The apparatus of claim 1, wherein the product settler is modular.

11. The apparatus of claim 1, wherein the product settler comprises a frame configured to spatially fix the product settler in relation to a path of the partially formed package.

12. The apparatus of claim 1, wherein the product settler comprises a first adjustable mount configured to move the product settler in a first direction.

13. The apparatus of claim 1, wherein the paddle wheel comprises a plurality of paddles.

14. The apparatus of claim 1, wherein the apparatus comprises a form, fill and seal machine.

15. The apparatus of claim 14, wherein the form, fill and seal machine comprises two seal jaw carriages; wherein a plurality of seal jaws are fixed to the seal jaw carriages; wherein the plurality of seal jaws are configured to form a first end seal to provide the partially formed package; wherein the plurality of seal jaws are configured to form a second end seal, thereby forming a package from the partially formed package; and wherein the product settler is located adjacent to one and only one side of the seal jaw carriages.

16. The apparatus of claim 1, wherein the apparatus comprises a form, fill and seal machine configured to advance film continuously along a product conduit configured to conduct the product into the partially formed package.

17. The apparatus of claim 16, wherein the apparatus is configured so that the paddle wheel rotates intermittently by rotating, stopping rotation, and then rotating again; and wherein the apparatus is configured so that the paddle wheel rotates intermittently while the form, fill and seal machine advances film continuously along the product conduit.

18. The apparatus of claim 16, wherein the apparatus is configured so that the paddle wheel rotates continuously while the form, fill and seal machine advances film continuously along the product conduit.

19. The apparatus of claim 1, wherein the product settler is configured to be located adjacent to one and only one face of the partially formed package.

20. The apparatus of claim 1, wherein the product settler is configured so that the impact against the partially formed package occurs above the unsettled height of the product in the partially formed package and below a product conduit through which the product is introduced into the partially formed package.

21. The apparatus of claim 1, wherein the product settler is configured to agitate the partially formed package in a cycle that comprises: (i) impacting the partially formed package to move the partially formed package into a deformed position, and (ii) subsequently allowing the partially formed package to move out of the deformed position; and wherein the product settler is configured to repeatedly perform the cycle to cause a plurality of impacts against the partially formed package.

22. The apparatus of claim 1, wherein the product settler is configured to cause vibration of the partially formed package as a result of repeating a cycle involving the partially formed package, wherein the cycle comprises the partially formed package being pushed by the impact with the at least one paddle and then the partially formed package being allowed to return to a position of the partially formed package before the impact.

23. The apparatus of claim 1, wherein the product settler is configured to contact one and only one face of the partially formed package.

24. The apparatus of claim 1, wherein the product settler is configured to cause the impact repeatedly against the partially formed package, thereby providing impacts against the partially formed package at a rate of more than 180 impacts per minute.

25. The apparatus of claim 24, wherein the product settler is configured to cause the impact repeatedly against the partially formed package, thereby providing impacts against the partially formed package at a rate of up to 900 impacts per minute.

26. The apparatus of claim 1, wherein the product settler is configured to cause the impact repeatedly against the partially formed package, thereby providing impacts against the partially formed package at a rate of at least 300 and up to 900 impacts per minute.

27. The apparatus of claim 1, wherein the product settler is configured to operate intermittently.

28. The apparatus of claim 1, wherein the product settler is configured to operate continuously.

29. The apparatus of claim 1, wherein the apparatus comprises one and only one product settler and wherein the one and only one product settler is configured to cause impacts against one and only one face of the partially formed package.

30. The apparatus of claim 29, wherein the product settler comprises one and only one paddle wheel and wherein the one and only one paddle wheel is configured to cause impacts against the one and only one face of the partially formed package.

* * * * *